US011898486B2

(12) United States Patent
Wiland et al.

(10) Patent No.: US 11,898,486 B2
(45) Date of Patent: Feb. 13, 2024

(54) WATER PUMP ASSEMBLIES AND RELATED METHODS

(71) Applicant: Carter Fuel Systems, LLC, Cleveland, OH (US)

(72) Inventors: Brian David Wiland, Sterling Heights, MI (US); Brent Adam Berman, North Ridgeville, OH (US)

(73) Assignee: Carter Fuel Systems, LLC

( * ) Notice: Subject to any disclaimer, the term of this patent is extended or adjusted under 35 U.S.C. 154(b) by 0 days.

(21) Appl. No.: 17/882,473

(22) Filed: Aug. 5, 2022

(65) Prior Publication Data

US 2023/0040669 A1 Feb. 9, 2023

Related U.S. Application Data

(60) Provisional application No. 63/230,280, filed on Aug. 6, 2021.

(51) Int. Cl.

| | |
|---|---|
| ***F01P 7/16*** | (2006.01) |
| ***F01P 5/10*** | (2006.01) |
| *F01P 7/14* | (2006.01) |

(52) U.S. Cl.

CPC ..... *F01P 7/16* (2013.01); *F01P 5/10* (2013.01); *F01P 2007/146* (2013.01); *F01P 2025/08* (2013.01)

(58) Field of Classification Search

CPC ..... F01P 7/16; F01P 5/10; F01P 2007/146; F01P 2025/08

See application file for complete search history.

(56) References Cited

U.S. PATENT DOCUMENTS

| | | | | |
|---|---|---|---|---|
| 5,395,194 | A | 3/1995 | Johnson et al. | |
| 6,112,706 | A * | 9/2000 | Heer | F04D 15/0263 123/41.1 |
| 6,176,204 | B1 * | 1/2001 | Heer | F01P 5/10 417/423.12 |
| 7,946,781 | B2 | 5/2011 | Mudel et al. | |
| 11,118,478 | B2 | 9/2021 | Mancini et al. | |
| 2003/0029394 | A1 * | 2/2003 | Miyagawa | F01P 5/10 123/41.54 |

OTHER PUBLICATIONS

Carter Engineered, The Wayback Machine, Retrieved from the Internet Sep. 7, 2023, URL: <https://web.archive.org/web/20200731044012/https://carterengineered.com/>.

The Trainer #104: Why Water Pumps Die and How to Avoid It, YouTube, Aug. 5, 2020, Retrieved from the Internet Sep. 7, 2023, URL: <https://www.youtube.com/watch?v=oFgZtAYGegl>.

(Continued)

*Primary Examiner* — Syed O Hasan

(57) ABSTRACT

This disclosure relates to improved water pump assemblies and related methods. The water pump assemblies can include pre-mounted fasteners and gaskets to facilitate easy installation or reinstallation of the water pump assemblies. The water pump assemblies further can include a temperature-control valve assembly positioned within a housing of the water pump assembly. The water pump assembly can include a variety of other pre-installed components. Other embodiments are disclosed.

19 Claims, 38 Drawing Sheets

(56) References Cited

OTHER PUBLICATIONS

Carter Engineered, Water Pumps, The Wayback Machine, Retrieved from the Internet Sep. 7, 2023, URL: <https://web.archive.org/web/20211024203044/https:/carterengineered.com/carter-water-pumps/>.
Carter Engineered, Rapid Fit Water Pumps, The Wayback Machine, Retrieved from the Internet Sep. 7, 2023, URL: <https://web.archive.org/web/20210802155102/https:/carterengineered.com/carter-water-pumps/rapid-fit-water-pumps>.
Carter Engineered, What's the difference between new and remanufactured water pumps?, Aug. 16, 2021, Retrieved from the Internet Sep. 7, 2023, URL: <https://web.archive.org/web/20210827163548/https:/www.aftermarketnews.com/whats-the-difference-between-new-and-remanufactured-water-pumps/>.
Carter Fuel Systems, LLC, Water Pump Catalog, CWP-M5-2023.

* cited by examiner

WATER PUMP ASSEMBLIES AND RELATED METHODS

CROSS-REFERENCE TO RELATED APPLICATIONS

This application claims benefit of, and priority to, U.S. Provisional Application No. 63/230,280 filed on Aug. 6, 2021. The content of the above-identified application is herein incorporated by reference in its entirety.

TECHNICAL FIELD

This disclosure is related to water pump assemblies and related methods.

BACKGROUND

Many engine assemblies, such as engine assemblies included in cars and other vehicles that utilize water circulated cooling systems, include or utilize water pumps. A water pump can function to circulate coolant through various components of an engine assembly, such as an engine block, hoses, radiator, and/or other components. The water pump maintains optimal operating temperatures by circulating fluid(s) through the engine assembly during usage.

Before a water pump assembly is installed, it may be necessary to remove a previously installed gasket in the engine assembly. For example, a gasket located at the interface between an engine block and a previously installed water pump assembly may require removal. In many cases, removal of the gasket can be difficult, and proper attention should be taken to ensure the gasket is properly removed. Improperly removing the gasket can result in damage to the engine assembly and/or leakage of coolant after a new water pump assembly is installed.

During installation or replacement of a water pump assembly, a plurality of fasteners (e.g., bolts, screws, nuts, studs, etc.) may be utilized to attach a water pump to an engine assembly. For example, in some cases, fasteners may be received via openings in the water pump, and the fasteners may be connected to an engine block or other component in the engine assembly. One or more gaskets also may be utilized to connect the water pump to the engine assembly in order to prevent leakage of coolant during operation. Because the fasteners and gaskets are separate components that are not included with the water pump, an individual desiring to install the water pump in the engine assembly must know which fasteners and gaskets are appropriate for use with the particular water pump and engine assemblies. This can be particularly difficult for individuals who are not familiar with water pump and/or engine assembly configurations. In addition, even if appropriate fasteners and gaskets can be identified and located, the fasteners and gaskets can become lost or misplaced.

When replacement of the original water pump is required, it is often necessary to replace fasteners and other gaskets (which are not included and must be obtained separately from the water pump) to successfully comply with an original specification for the water pump and/or engine assembly. Proper torque of the replacement water pump can be negatively impacted by reuse of original fasteners and/or gaskets, and improper fastening procedures.

Moreover, during installation of a new water pump, it is often very difficult to connect the water pump with fasteners to an engine assembly while simultaneously holding or situating a gasket in a proper location. In many cases, this can require two or more individuals to install the water pump, whereby one individual holds the gasket in place and the other individual attaches the water pump to the engine assembly with the fasteners.

Accordingly, there is a need for improved water pump assemblies that overcome some or all the aforementioned challenges, as well as other challenges, and provide advanced features that allow such pumps to be installed more easily and operate more efficiently.

BRIEF DESCRIPTION OF DRAWINGS

To facilitate further description of the embodiments of this disclosure, the following drawings are provided, in which like references are intended to refer to like or corresponding parts, and in which.

Figure 1A:
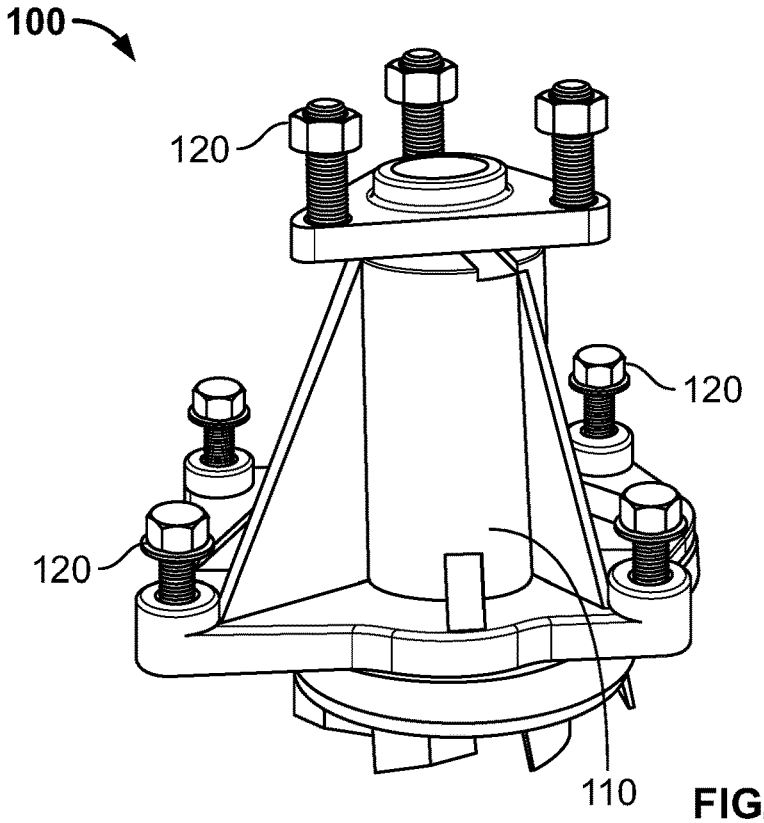
FIG. 1A is side view of an exemplary water pump assembly in accordance with certain embodiments.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Coupling may be for any length of time, e.g., permanent or semi-permanent or only for an instant. The absence of the word "removably," "removable," and the like near the word "coupled," and the like does not mean that the coupling, etc. in question is or is not removable.

In some cases, two or more elements can be "integral" if they are comprised of the same piece of material and/or connected in a non-removal fashion. Conversely, two or more elements can be "non-integral" if each is comprised of a different piece of material and/or the elements are connected in a removable fashion.

In many cases, "approximately" can mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

DETAILED DESCRIPTION OF EXEMPLARY EMBODIMENTS

The present disclosure relates to improved replacement water pump assemblies and related methods of use. The water pump assemblies can include a variety of pre-mounted, pre-installed, and/or pre-packaged components that enable easy attachment of the water pump assemblies to engine assemblies and supplement the functionality of the water pump assemblies. Exemplary components that may be pre-mounted, pre-installed, and/or pre-packaged with the water pump assemblies can include fasteners, gaskets, thermostats, gasket removers, and/or other components. The components may be incorporated into the water pump assemblies using one or more retainer structures and/or may be directly integrated into the housings, bodies, and/or structural features of the water pump assemblies. As explained in further detail below, the water pump assemblies and/or associated components can provide a comprehensive solution for installing and/or replacing water pump assemblies.

The components incorporated into, or included with, the water pump assemblies permit the water pump assemblies to be easily connected to, or installed on, various engine assemblies. In the event that a gasket included on an engine assembly requires removal prior to installation of a water pump assembly, one or more gasket removers included with the water pump assembly can be utilized to quickly and easily remove the gaskets. Moreover, individuals seeking to install a water pump assembly do not need to research or identify the particular fasteners and gaskets that are compatible with the water pump assembly and/or the corresponding engine assembly on which the water pump assembly is being installed. Rather, the fasteners and gaskets can be pre-installed and/or pre-mounted on the water pump assemblies, thereby eliminating the need to identify appropriate hardware and preventing the fasteners and gaskets from becoming lost or misplaced. Furthermore, including the fasteners and gaskets on the water pump assemblies allows a single individual to easily connect the water pump assemblies to engine assemblies. For example, when connecting the water pump assemblies to engine assemblies, it may not be necessary to connect the water pump assemblies with fasteners while simultaneously holding or situating one or more gaskets in proper locations (e.g., because the gaskets are pre-installed or pre-mounted in the proper locations where the water pump assemblies and engine assemblies interface with each other).

Additional advantages can be attributed to additional features and components that may be included with the water pump. For example, in certain embodiments, thermostats can be directly connected to and/or installed on the water pump assemblies to control the coolant that is provided to corresponding engine assemblies. Unlike existing engine assemblies in which water pump assemblies and thermostats are separate components that cooperate together, the functionality of the water pump assemblies can be enhanced by directly integrating the thermostats with the water pump assemblies.

Each water pump assembly may include one or more retainer structures that assist with incorporating or attaching fasteners on to the water pump assembly. The arrangements and configurations of the retainer structures can vary. In some embodiments, the one or more retainer structures may include Axi-Rad® retainers currently being manufactured by Forrest City Technologies. Other types of retainer structures may also be utilized. In some cases, each of the retainer structures may be attached to a housing and/or outer surface of the water pump assembly. The retainer structures also may be incorporated into, or attached to, the water pump assemblies in other ways as well.

A retainer structure may include a body portion that comprises one or more openings (e.g., holes), each of which is configured to receive and attach a fastener to a water pump assembly. Exemplary fasteners may include bolts, screws, studs, nuts, and/or other types of connectors or hardware. The openings may be precisely pre-cut into the retainer structures such that they align with corresponding openings included on water pump assemblies. During assembly of a water pump assembly, each retainer structure can be attached to the water pump assembly when the corresponding openings in the water pump assembly and retainer structure are aligned.

Each of the openings in the retainer structures may be designed and configured to receive a corresponding fastener of an appropriate size, and the corresponding fastener may be inserted or included in the opening when the water pump assembly is assembled. The size and design of the openings can be varied to accommodate any type of fastener. Depending upon the types of fasteners being inserted, the openings included in the retainer structure can include straight holes and/or tapered holes, and may be configured to accommodate threaded and non-threaded fasteners. Regardless of the particular configuration of the retainer structure openings and the fasteners, the fasteners can be included in the openings when the water pump assembly is assembled, thus permitting the water pump assembly to be quickly and easily attached to an engine assembly.

In certain embodiments, some or all of the water pump assemblies also may include one or more pre-installed gaskets. The one or more pre-installed gaskets may be included directly on an outer surface or body portion of the water pump assemblies. Alternatively, or additionally, the retainer structures may be utilized to incorporate the gaskets into the water pump assemblies. Regardless of how the gaskets are integrated into the water pump assemblies, the gaskets can be used to seal junctions and/or connections between the water pump assemblies and one or more components of the engine assemblies. For example, in some cases, a gasket pre-installed on a water pump assembly can be used to seal a connection between the water pump assembly and an engine block in order to prevent leakage of coolant.

In certain embodiments, the water pump assemblies can include other types of components. For example, in certain embodiments, each water pump assembly can include one or more pre-mounted, encapsulated, and/or pre-installed thermostats. Each of the one or more thermostats may be configured to regulate a temperature of an engine assembly (or portion thereof) coupled to, or associated with the, a water pump assembly. Each thermostat can be configured to ensure that a corresponding engine assembly operates at an optimal or acceptable operating temperature and/or within an optimal or acceptable temperature range (e.g., in some cases, between 195-220 degrees Fahrenheit). In certain embodiments, the thermostats can be configured to analyze the temperature of an engine assembly (or portion thereof), and to automatically apply an appropriate amount of coolant to the engine assembly components (e.g., to a hose, radiator, and/or engine block) which is sufficient to cause the temperature of the engine assembly to be within an optimal or acceptable temperature range.

In certain embodiments, the thermostat (and the associated water pump assembly that includes the thermostat) may be situated between an engine block and a radiator of a vehicle. The thermostat may operate as a regulation valve that allows or blocks the flow of coolant from the engine block into the radiator. For example, if the engine block exceeds a certain temperature threshold, the thermostat may open and permit coolant to flow into the radiator to cool down the engine assembly.

In certain embodiments, the thermostats may include, or communicate with, one or more thermal sensors to analyze the temperature of the engine assembly. For example, in certain embodiments, each water pump assembly can include, or communicate with, one or more thermal sensors. In certain embodiments, the one or more thermal sensors can be located in the engine assembly and the temperature readings generated from the one or more thermal sensors can be communicated to the water pump assemblies (e.g., the thermostat included in the water pump assemblies). Additionally, or alternatively, the one or more thermal sensors can be pre-installed and/or pre-mounted on the water pump assemblies themselves. The thermal sensors can include any known sensors that are configured to measure temperatures. Each of the one or more thermal sensors may be configured to measure a temperature of an engine assembly (or portion thereof) coupled to, or associated with the, a water pump assembly. In some cases, the one or more thermal sensors may include one or more coolant temperature sensors that measure the temperature of coolant flowing through an engine assembly.

As mentioned above, one or more gasket removers also may be pre-packaged or included with the water pump assembly to enable removal of gaskets previously installed in the engine assembly. Exemplary gasket removers may include liquids that are capable of dissolving a gasket. The gasket removers additionally, or alternatively, may include tools or instruments (e.g., razors, scrapers, knives, cutting instruments, etc.) for physically removing the gaskets.

Any of the pre-mounted and/or pre-installed components (including, but not limited to, the fasteners, gaskets, thermostats, and/or other components) mentioned in this disclosure can be attached to the water pump assemblies using retainer structures and/or by directly integrating them into the structures of the water pump assemblies. For example, in certain embodiments, some or all of these components can be attached to the water pump assemblies using retainer structures that include various openings and/or structural features for connecting, housing, and/or securing the components. Additionally, or alternatively, the components can be directly attached and/or integrated into body portions of the water pump assemblies using various connection schemes, openings, and/or structural features included on the body portions of the water pump assemblies.

The water pump assemblies and associated components can be constructed of various materials. For example, body portions of the water pump assemblies may be constructed of metal in some cases. The body portions additionally, or alternatively, can be constructed of plastics and/or other materials in some cases. The retainer structures can be constructed of thermoplastics and/or other plastics in some embodiments. The retainer structures additionally, or alternatively, can be constructed of metals and/or other materials in some cases. The fasteners (e.g., screws, bolts, nuts, etc.) can be constructed of metals in certain embodiments. The fasteners can be constructed of plastics and/or other materials in some embodiments. The gaskets may be constructed of rubber, neoprene, nitrite rubber, and/or other similar materials. Additionally, or alternatively, the gaskets may be constructed of silicone, metal, cork, fiberglass, polytetrafluoroethylene, and/or a plastic polymer (e.g., such as polychlorotrifluoroethylene).

The water pump assemblies and associated components can be formed via casting or injection molding and can include casting burrs. To eliminate the casting burrs, the water pump assemblies and associated components can go through one or more finishing procedures prior to assembly. For example, the water pump assemblies and associated components can be tumbled polished or painted with an acrylic coating.

Figure 1B:
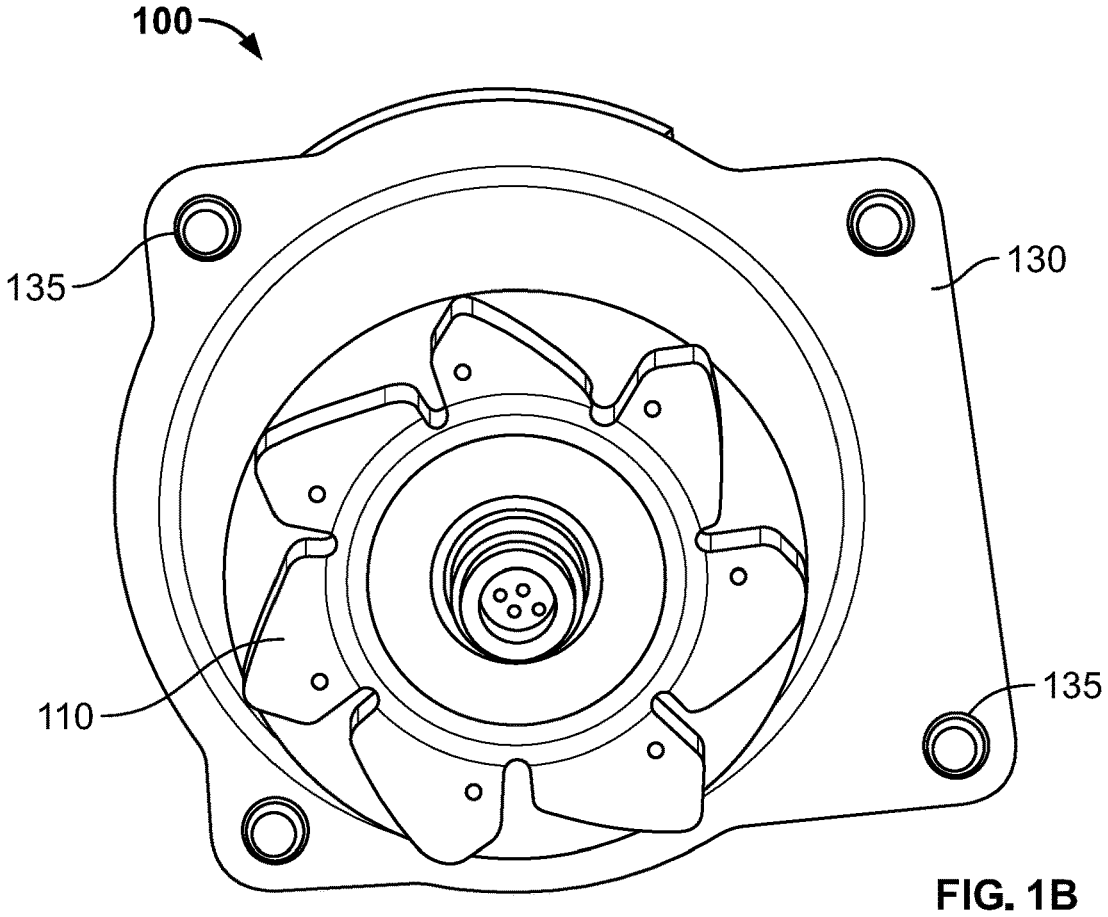
FIG. 1B is a bottom view of the exemplary water pump assembly illustrated in FIG. 1A.
Figure 2A:
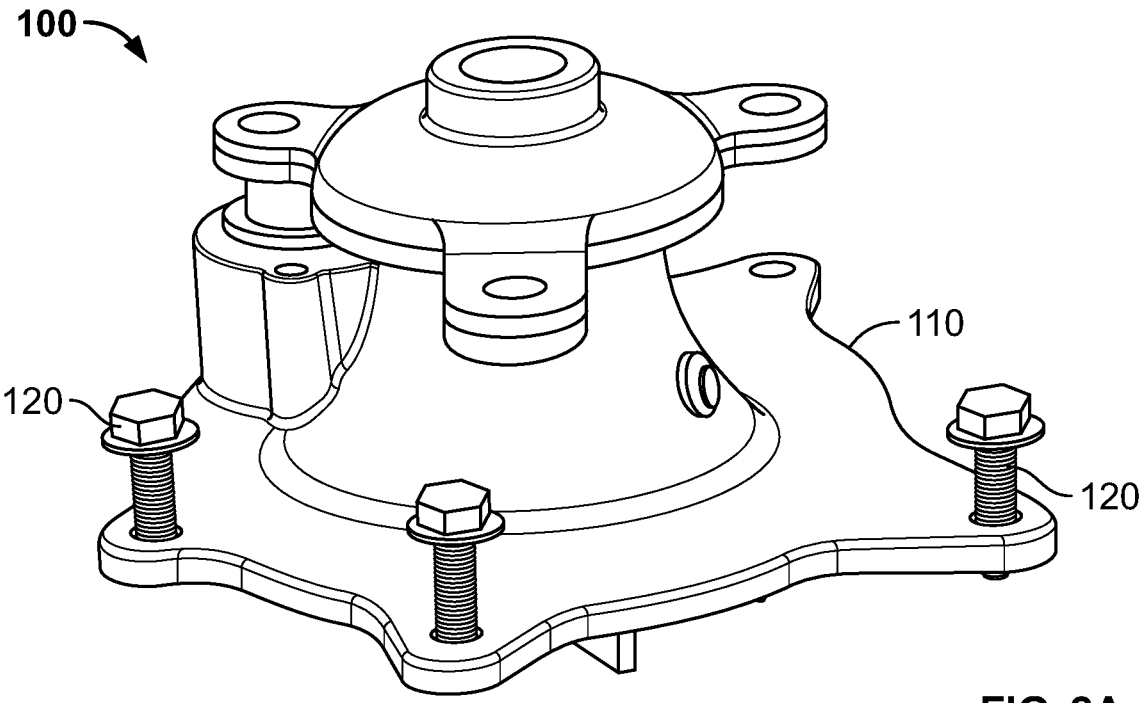
FIG. 2A is side view of an exemplary water pump assembly in accordance with certain embodiments.
Figure 2B:
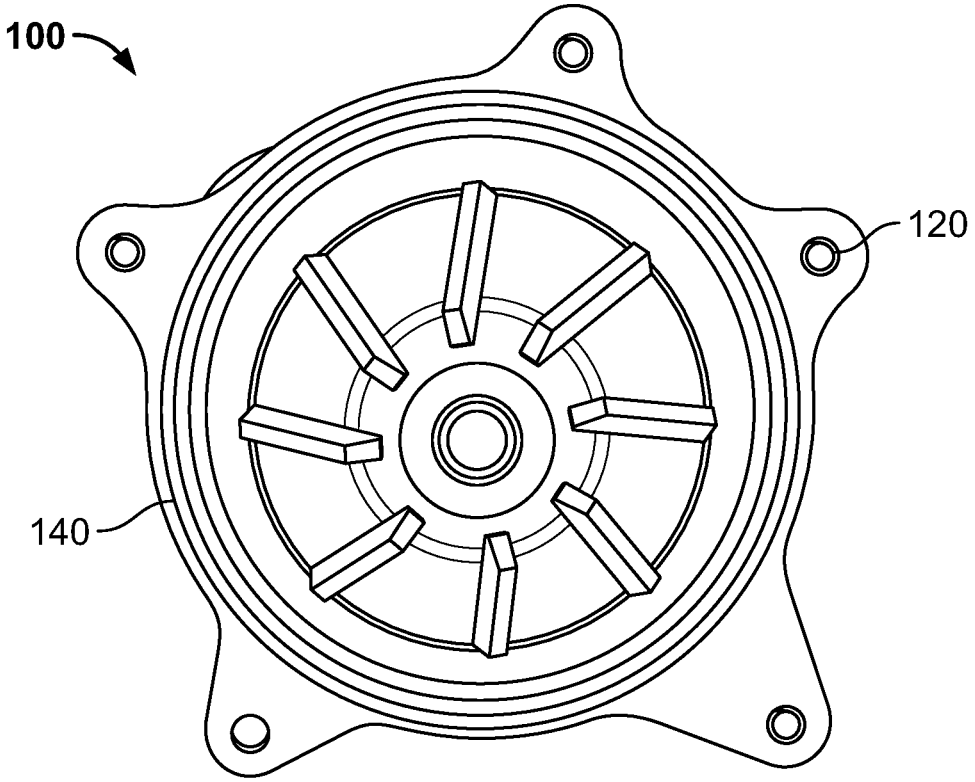
FIG. 2B is a bottom view of the exemplary water pump assembly illustrated in FIG. 2A.
Figure 7A:
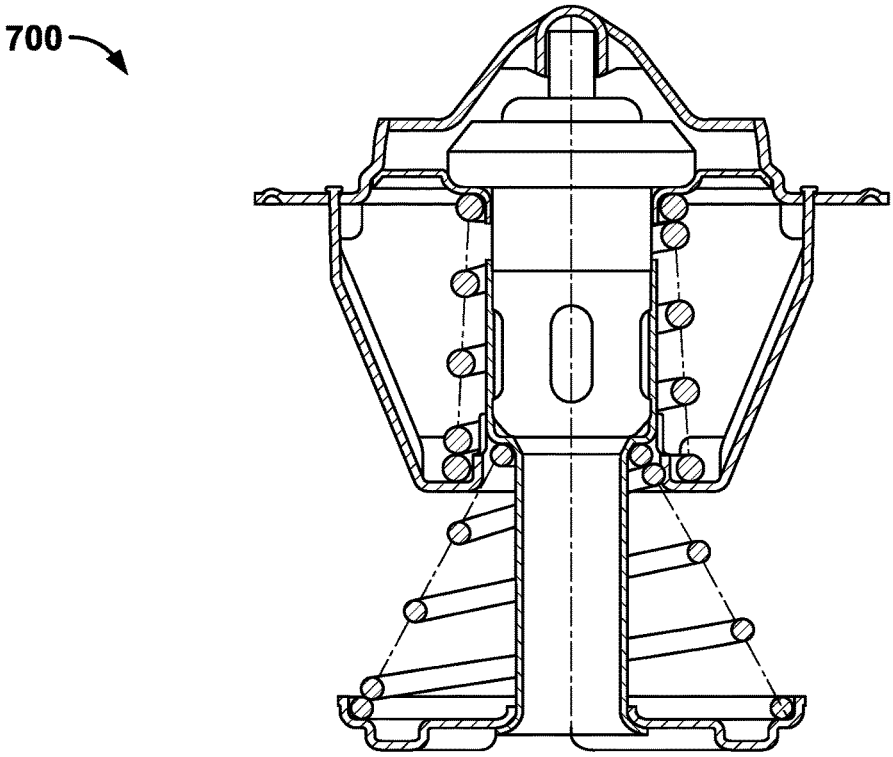
FIG. 7A illustrates an alternative temperature-control valve assembly according to certain embodiments.
Figure 7B:
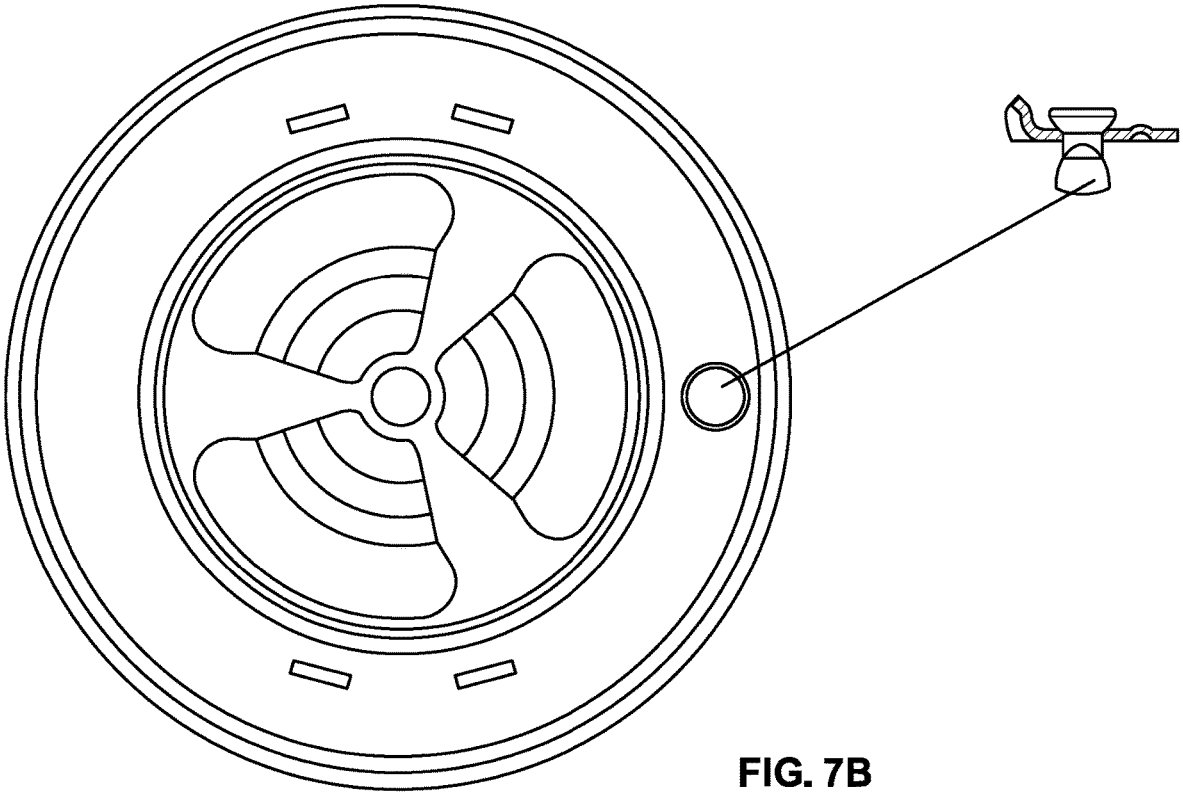
FIG. 7B illustrates an alternate view of the temperature-controlled valve assembly illustrated in FIG. 7A.
Figure 8B:
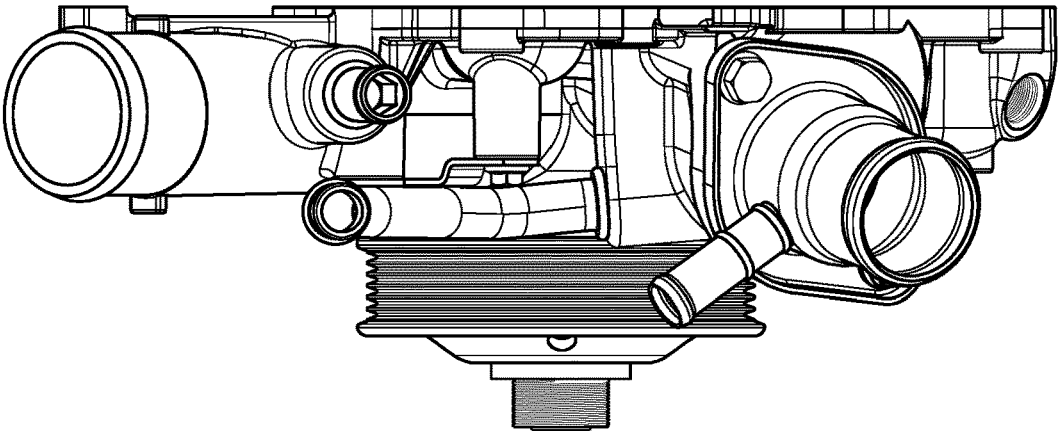
FIG. 8B illustrates an alternate view of the water pump assembly illustrated in FIG. 8A.
Figure 8A:
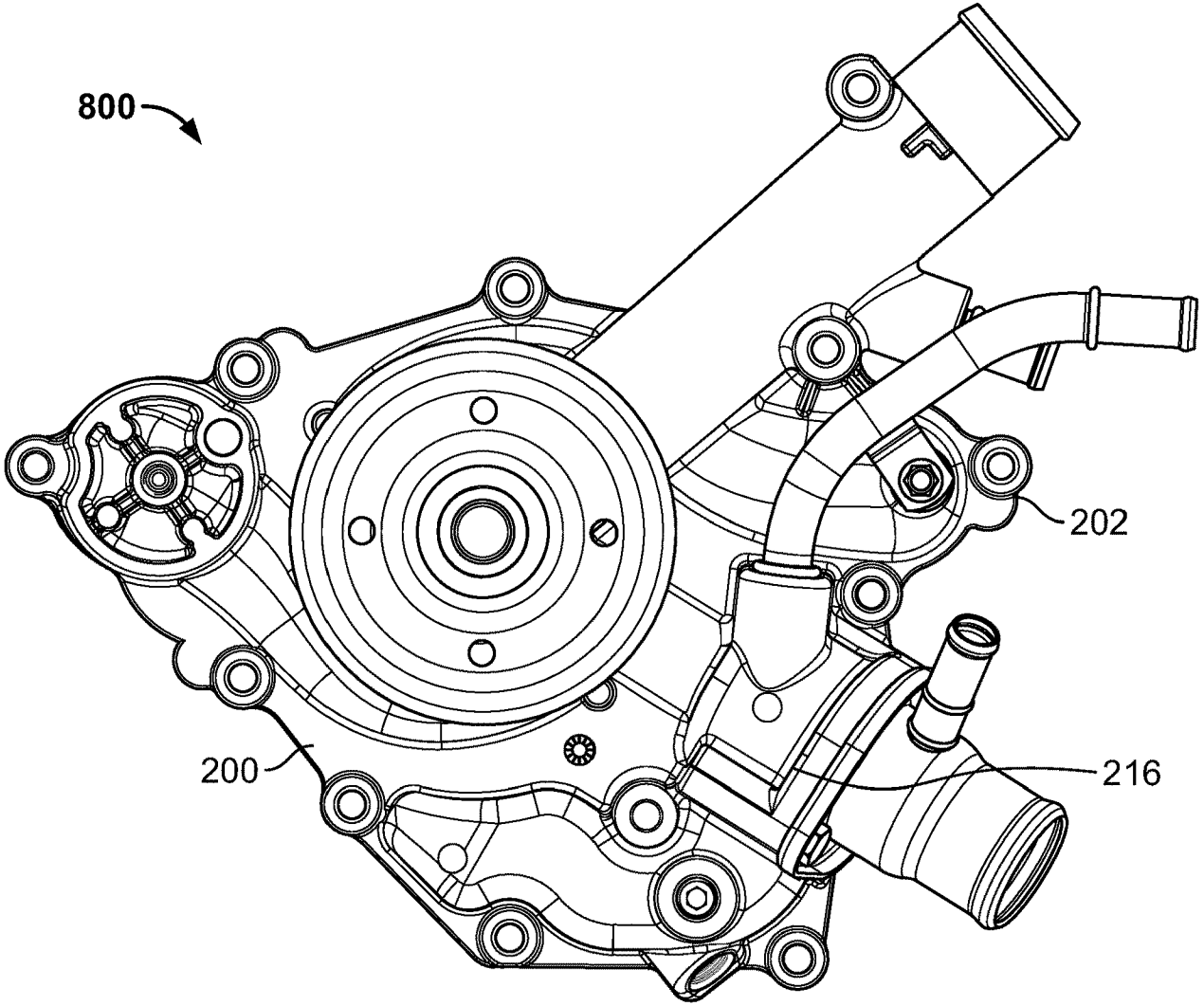
FIG. 8A illustrates an alternative water pump assembly according to certain embodiments.
Figure 9A:
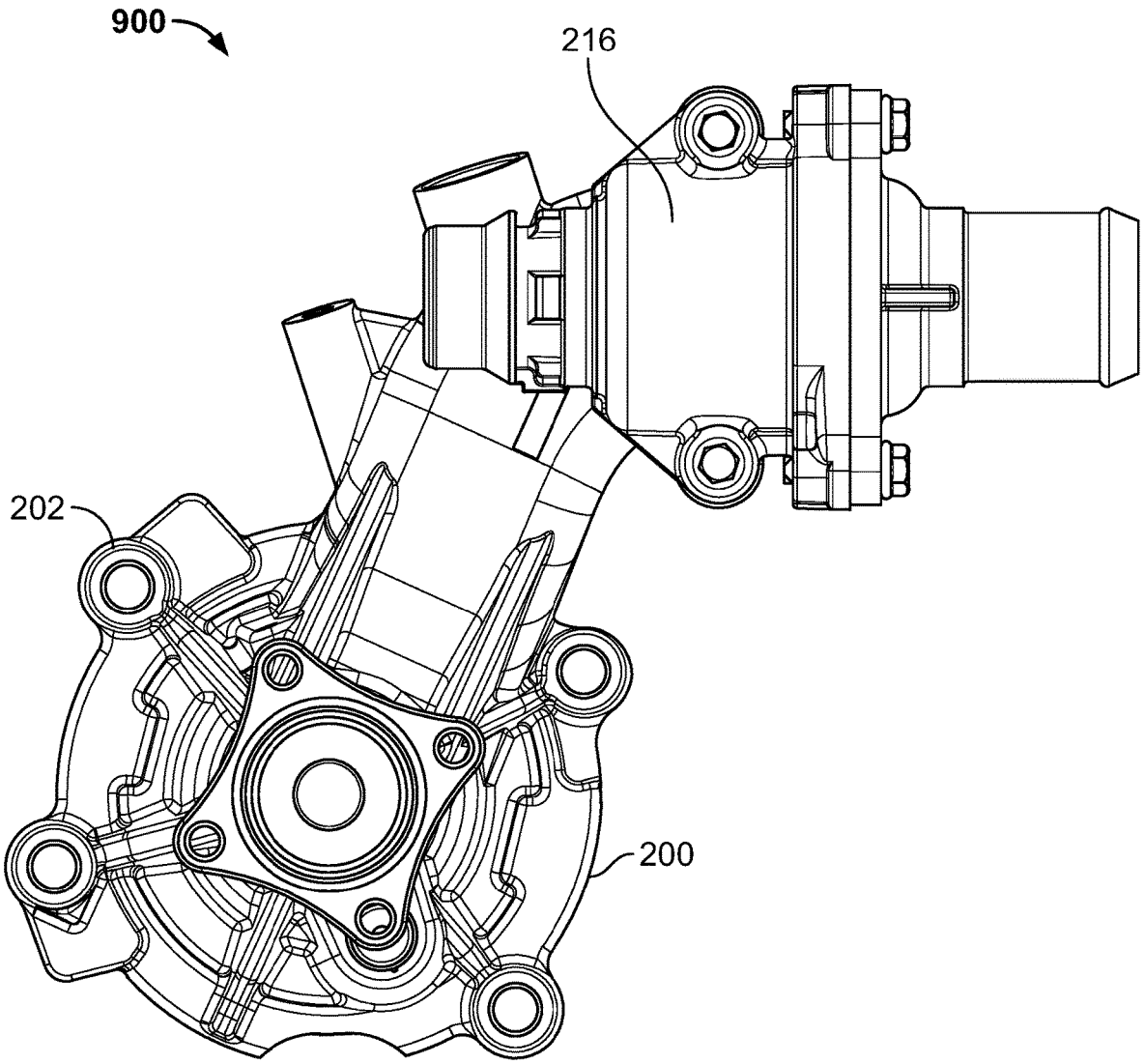
FIG. 9A illustrates an alternative water pump assembly according to certain embodiments.
Figure 9B:
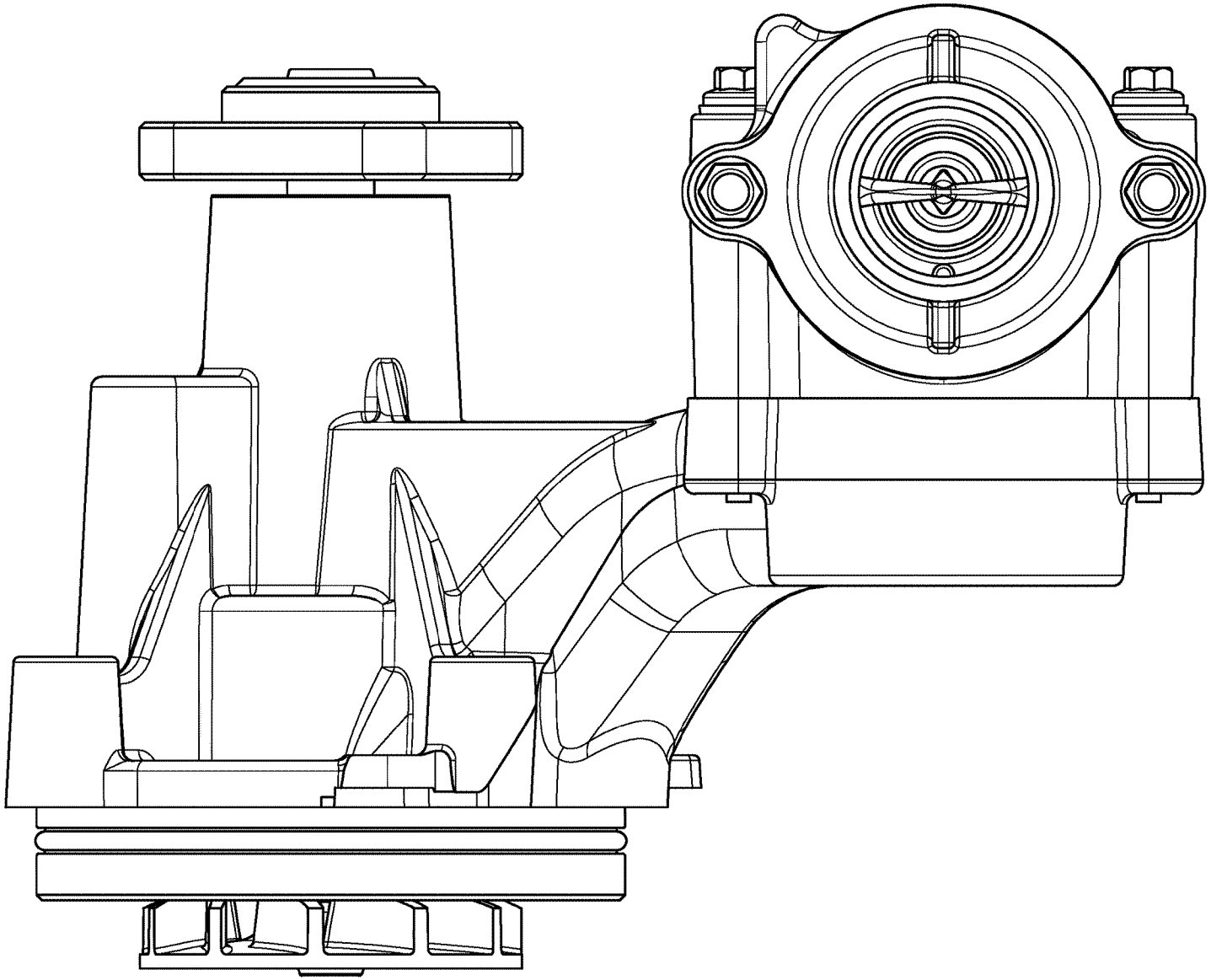
FIG. 9B illustrates an alternate view of the water pump assembly illustrated in FIG. 9A.
Figures 10A, 10B:
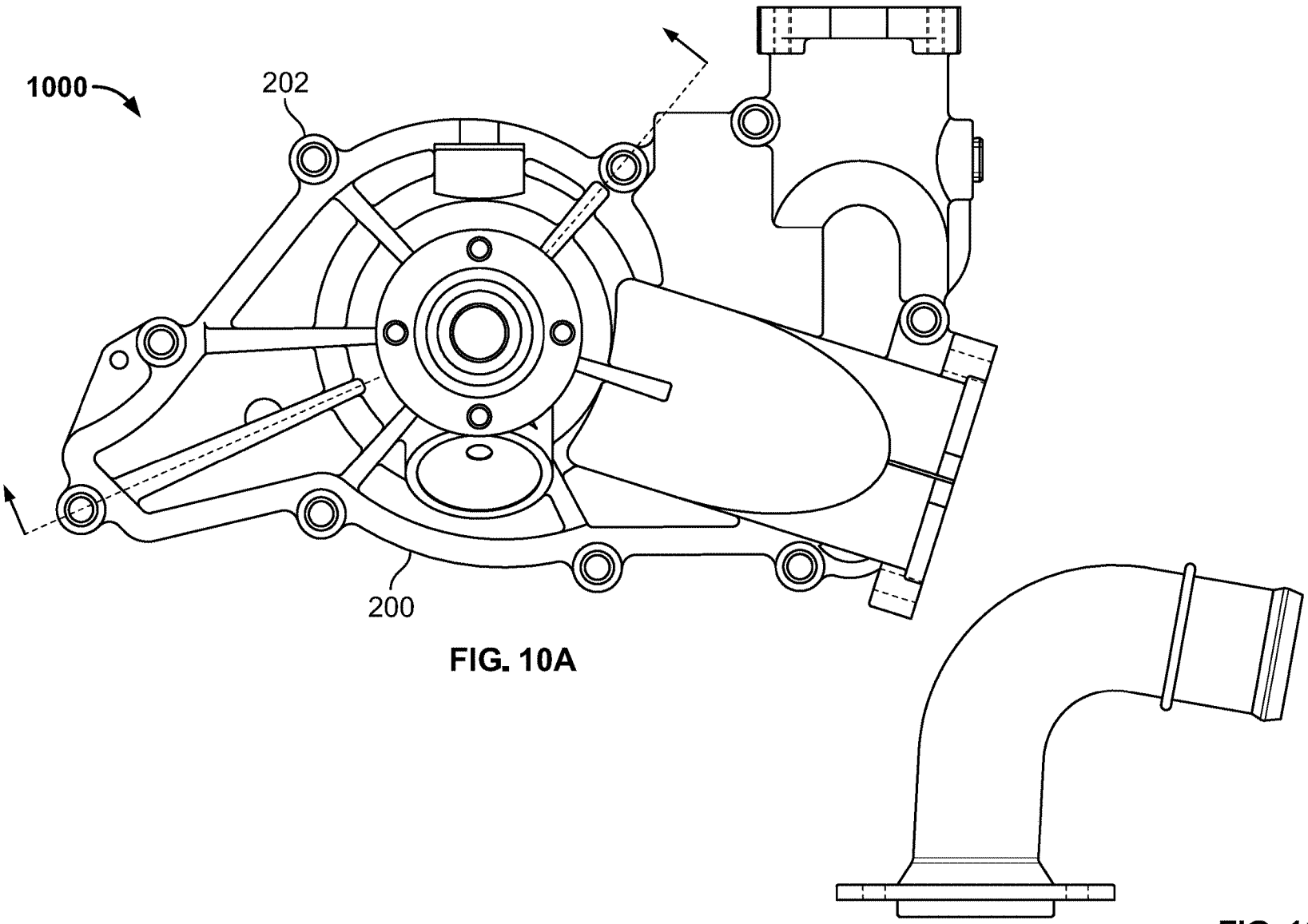
FIG. 10A illustrates an alternative water pump assembly according to certain embodiments.
FIG. 10B illustrates an alternate view of the water pump assembly illustrated in FIG. 10A.
Figure 11A:
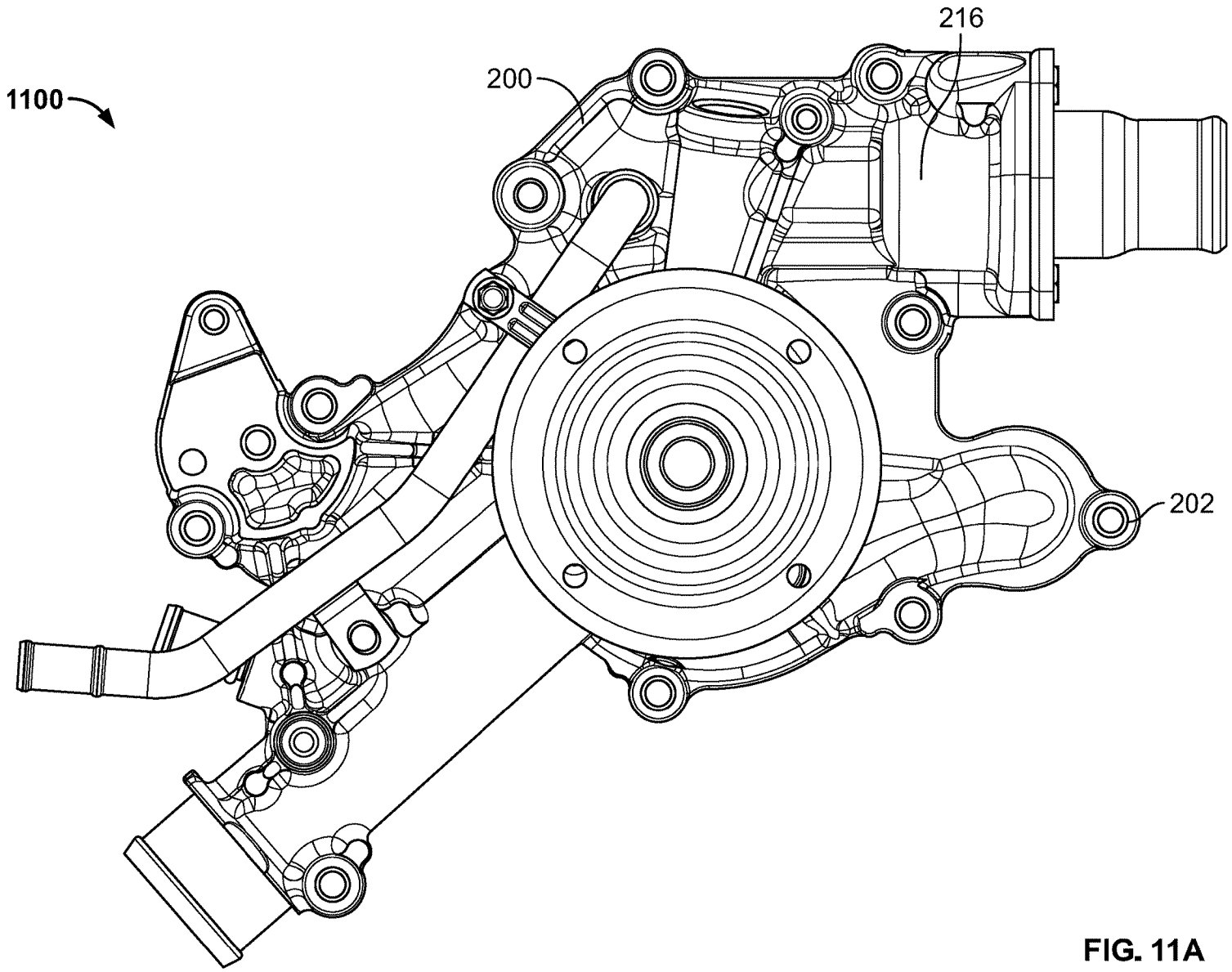
FIG. 11A illustrates an alternative water pump assembly according to certain embodiments.
Figure 11B:
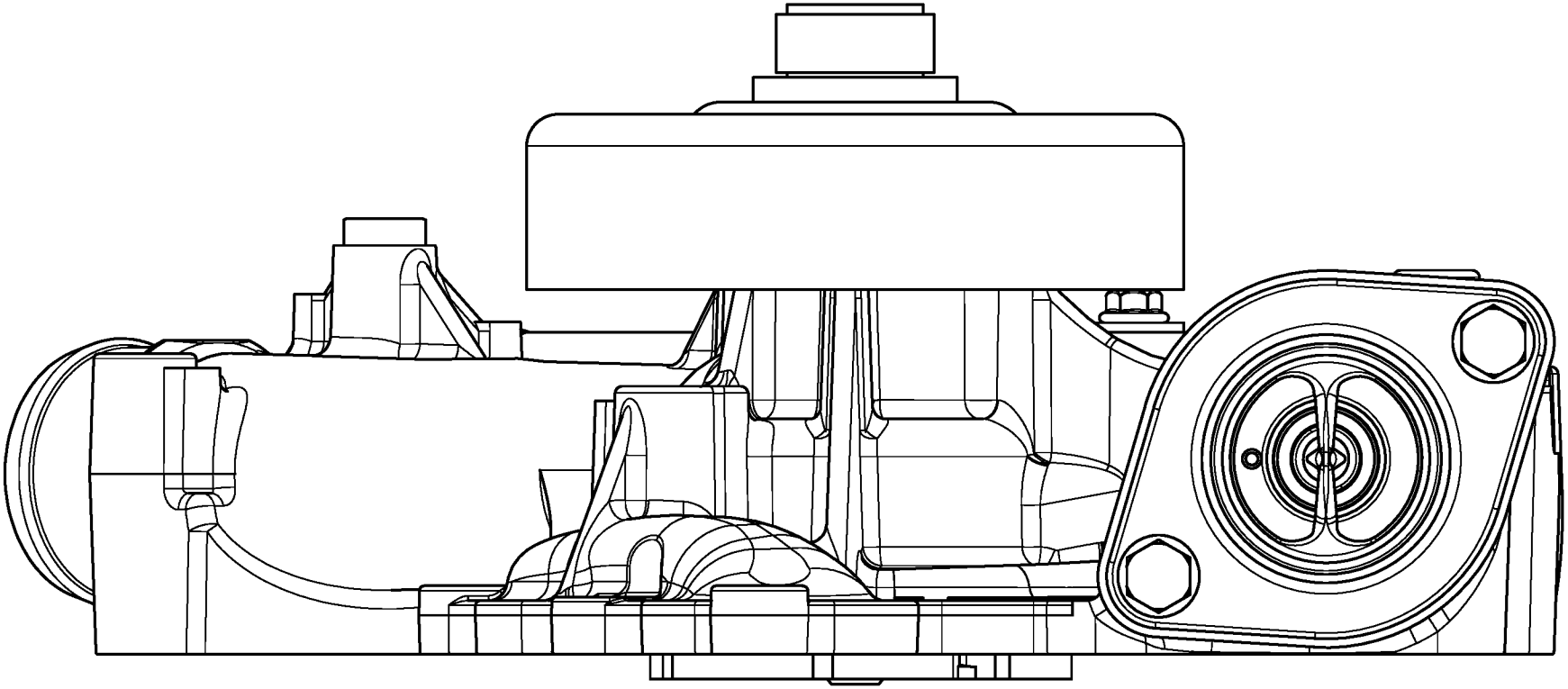
FIG. 11B illustrates an alternate view of the water pump assembly illustrated in FIG. 11A.
Figure 12A:
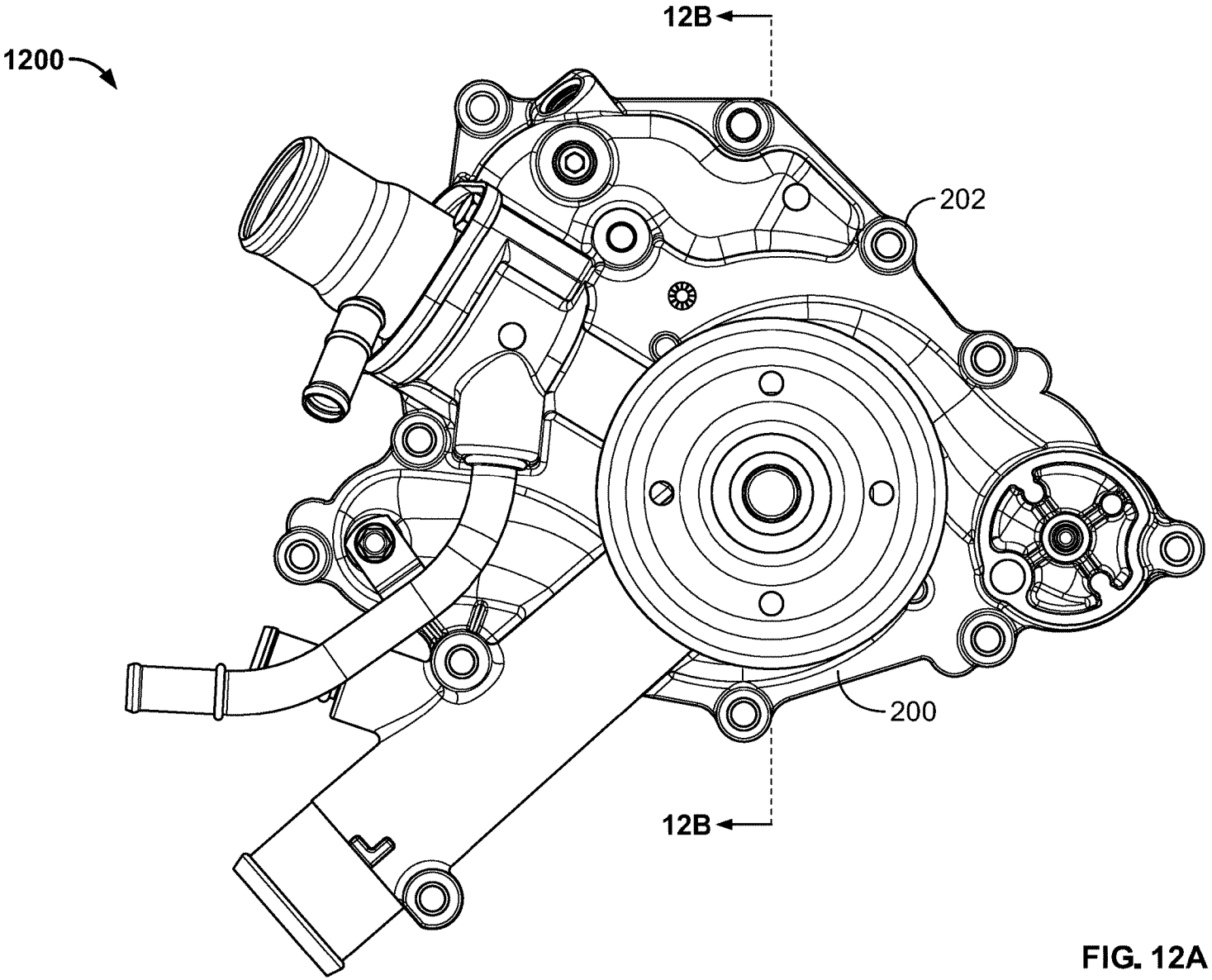
FIG. 12A illustrates an alternative water pump assembly according to certain embodiments.
Figure 12B:
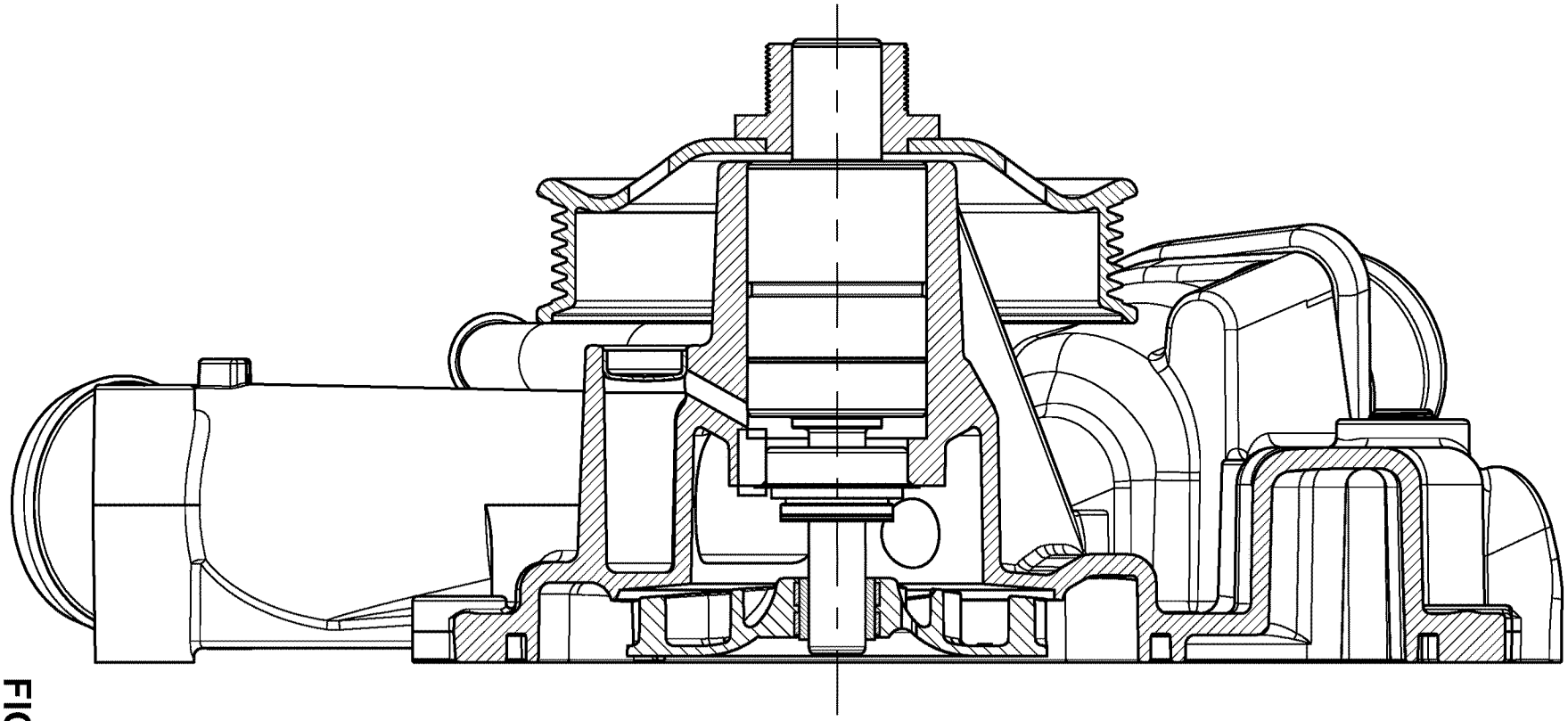
FIG. 12B illustrates an alternate view of the water pump assembly illustrated in FIG. 12A.
Figure 12C:
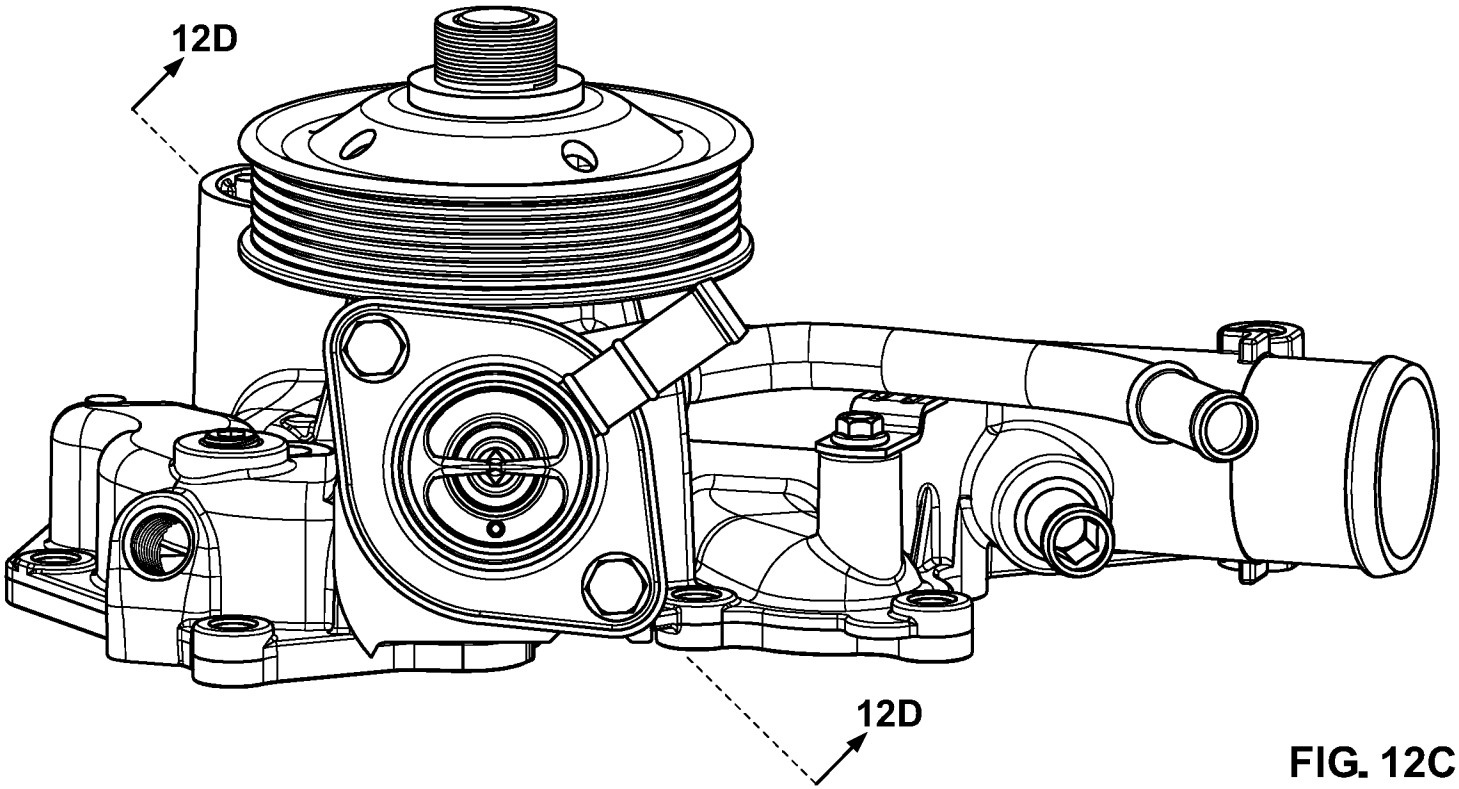
FIG. 12C illustrates an alternate view of the water pump assembly illustrated in FIG. 12A.
Figure 12D:
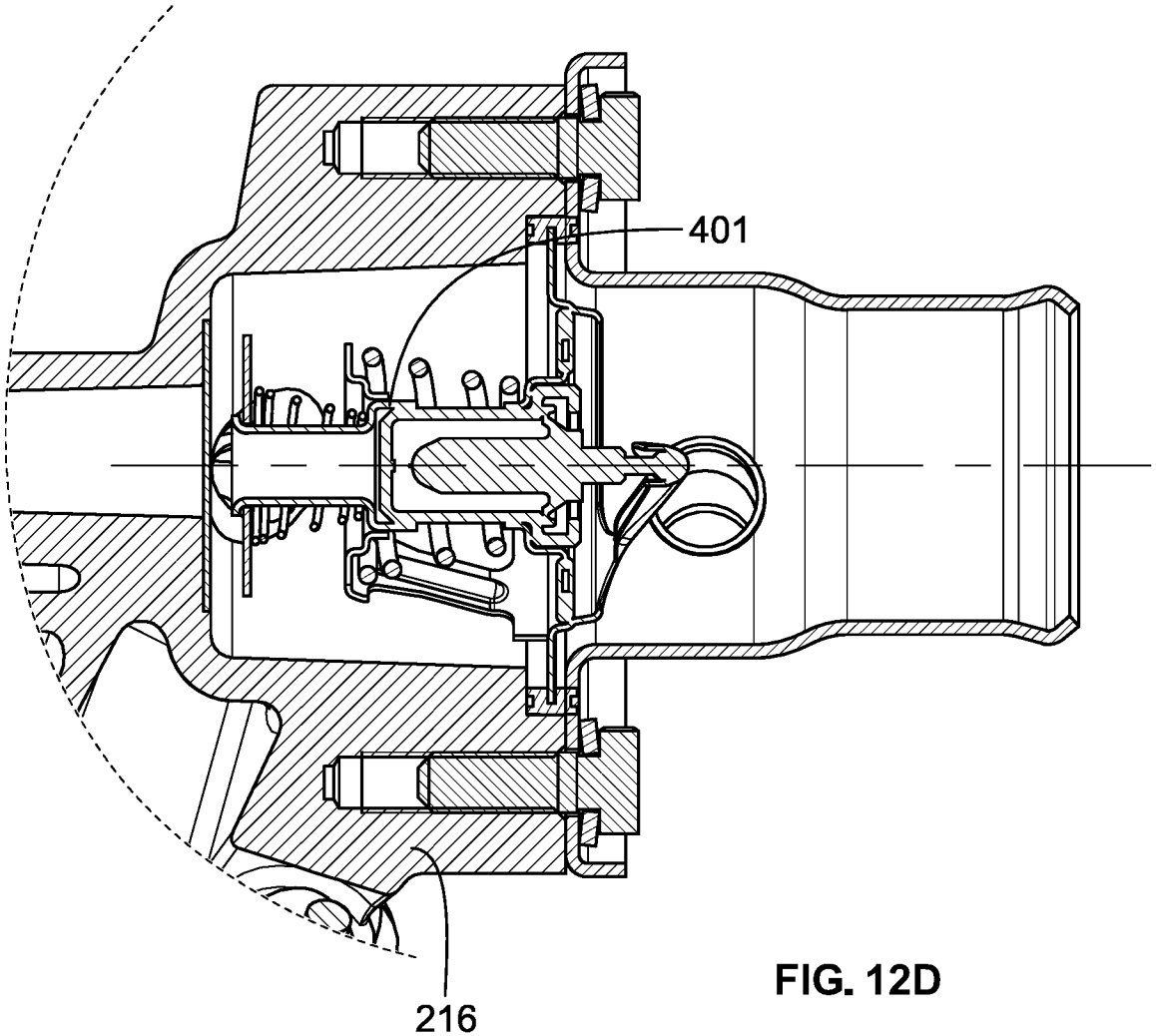
FIG. 12D illustrates an alternate view of the water pump assembly illustrated in FIG. 12A.
Figure 12E:
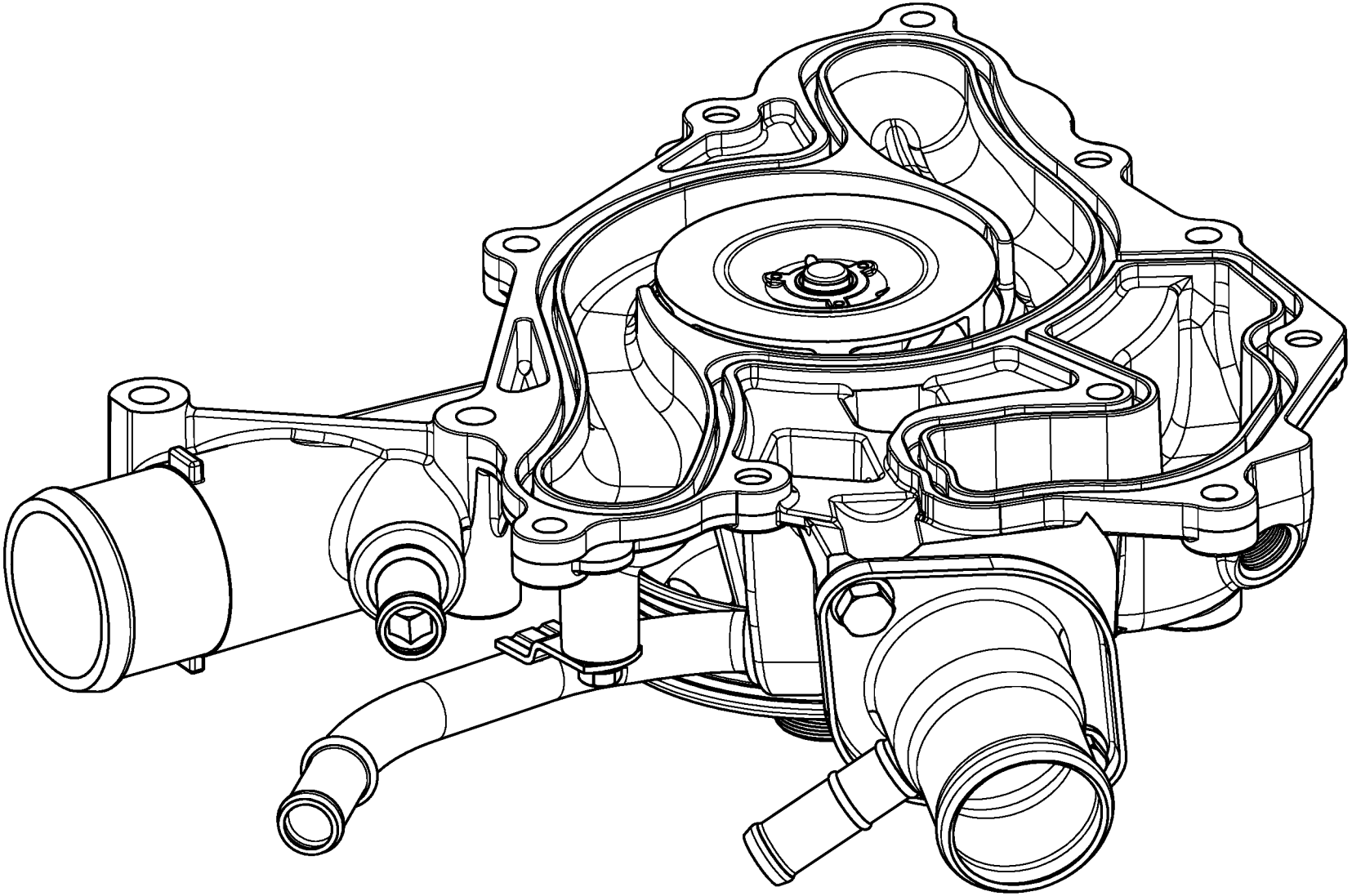
FIG. 12E illustrates an alternate view of the water pump assembly illustrated in FIG. 12A.
Figure 13A:
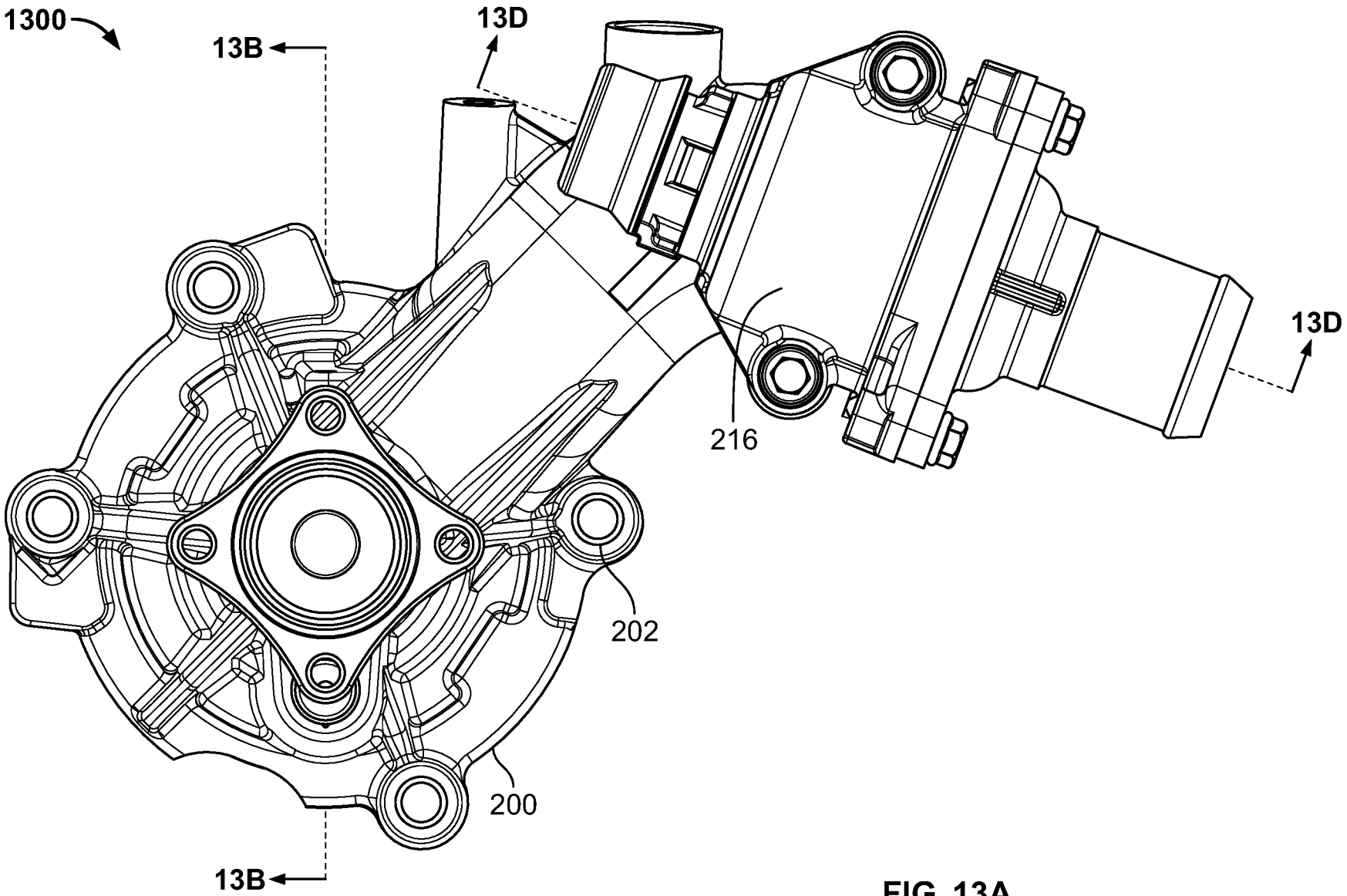
FIG. 13A illustrates an alternative water pump assembly according to certain embodiments.
Figure 13B:
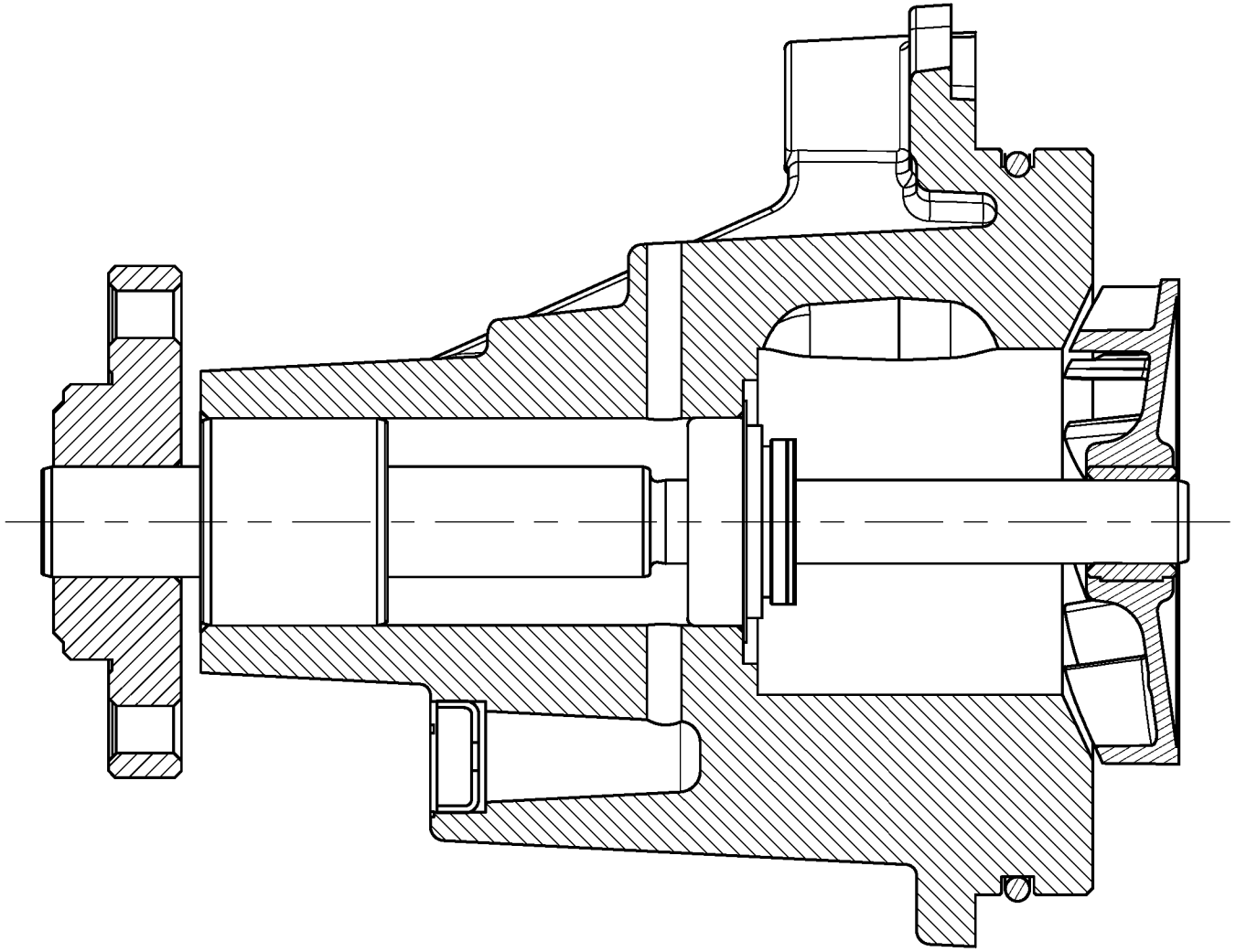
FIG. 13B illustrates an alternate view of the water pump assembly illustrated in FIG. 13A.
Figure 13C:
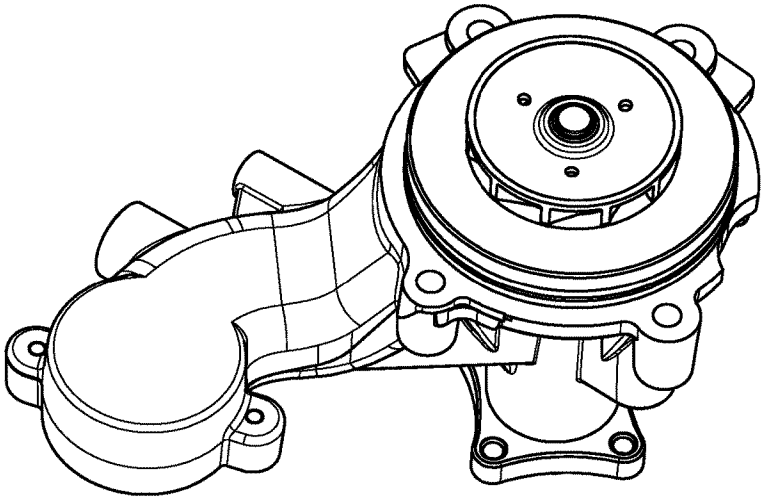
FIG. 13C illustrates an alternate view of the water pump assembly illustrated in FIG. 13A.
Figure 13D:
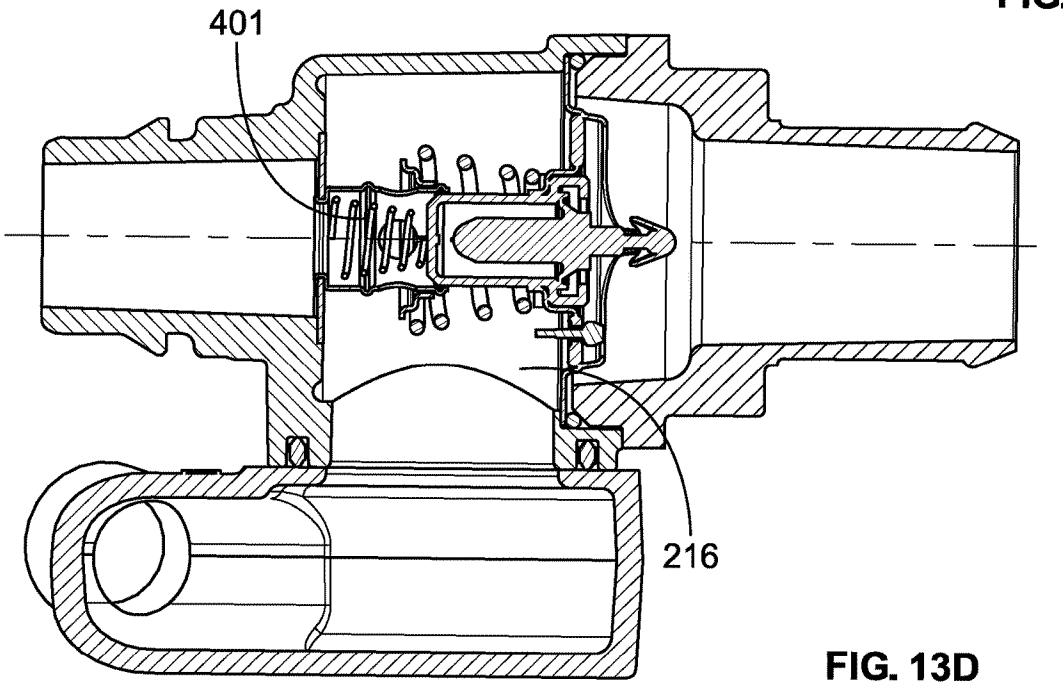
FIG. 13D illustrates an alternate view of the water pump assembly illustrated in FIG. 13A.
Figure 14A:
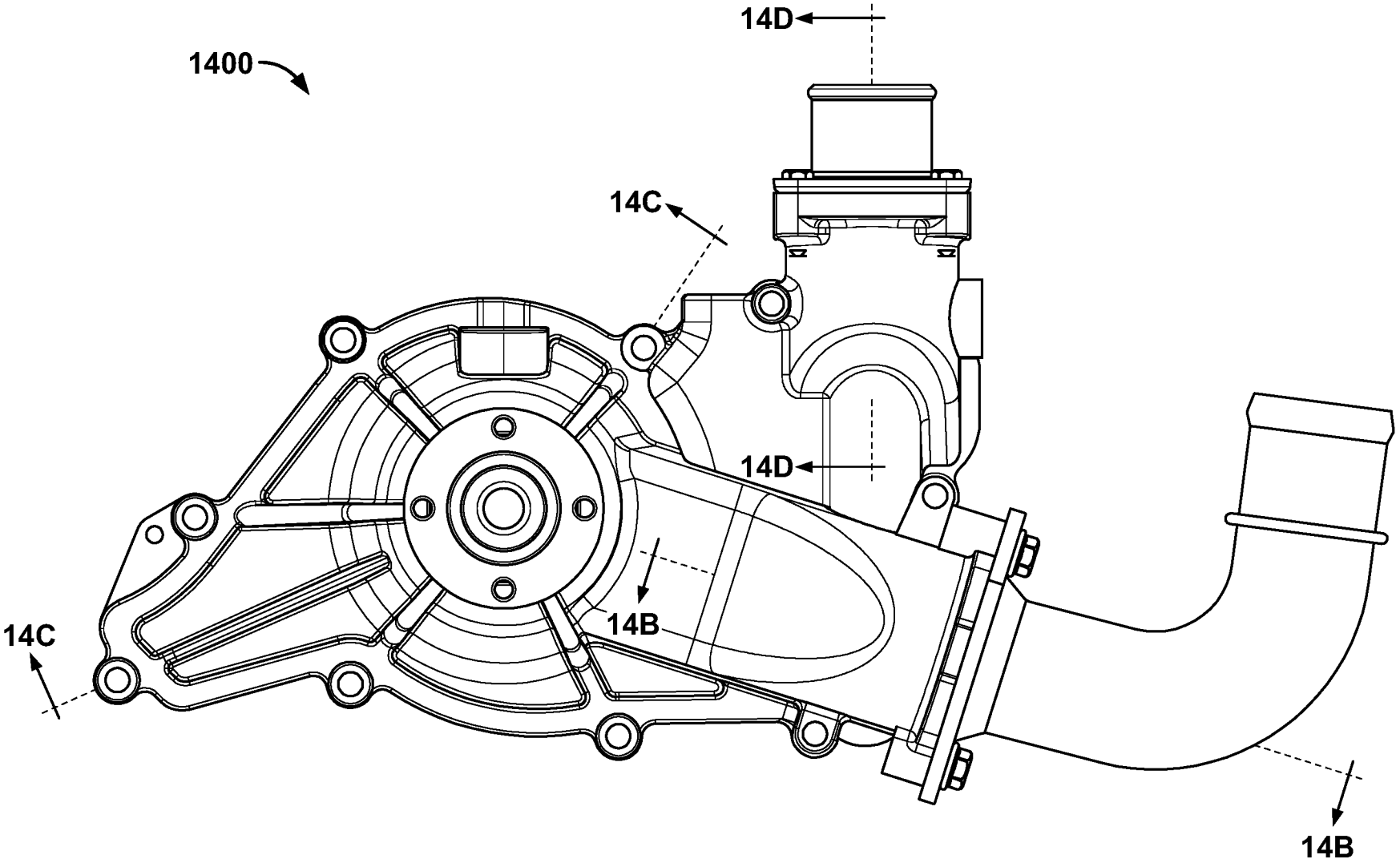
FIG. 14A illustrates an alternative water pump assembly according to certain embodiments.
Figure 14B:
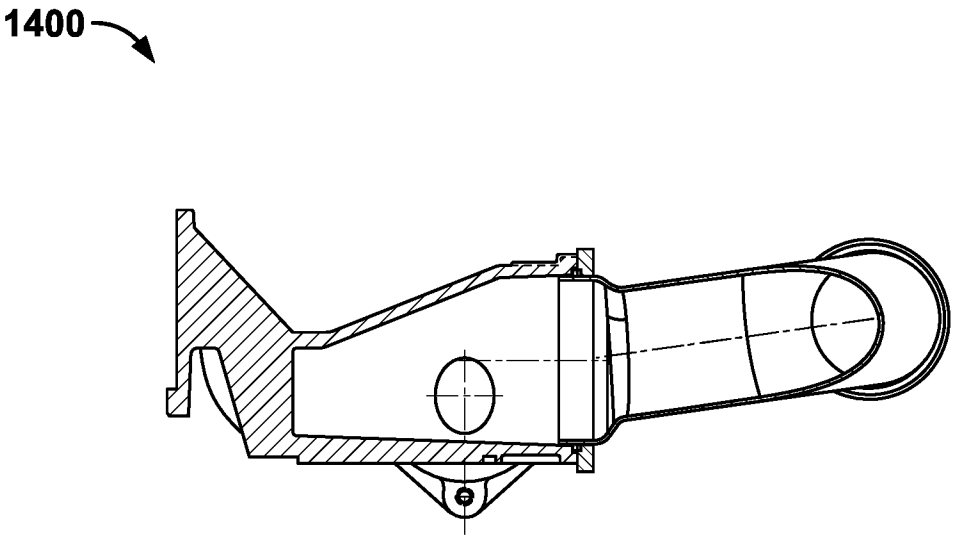
FIG. 14B illustrates an alternate view of the water pump assembly illustrated in FIG. 14A.
Figure 14D:
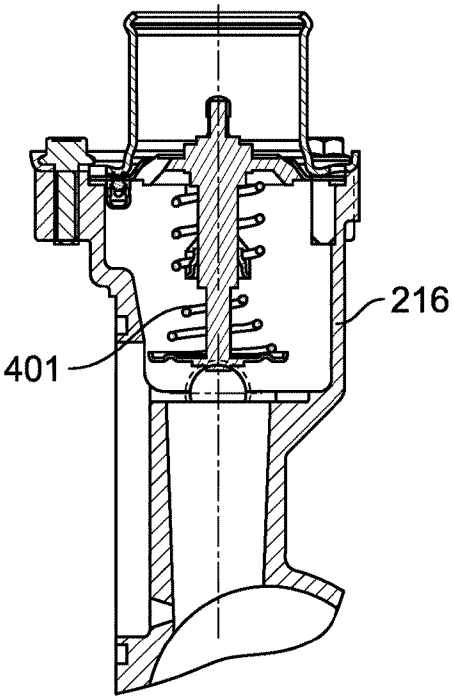
FIG. 14D illustrates an alternate view of the water pump assembly illustrated in FIG. 14A.
Figure 14C:
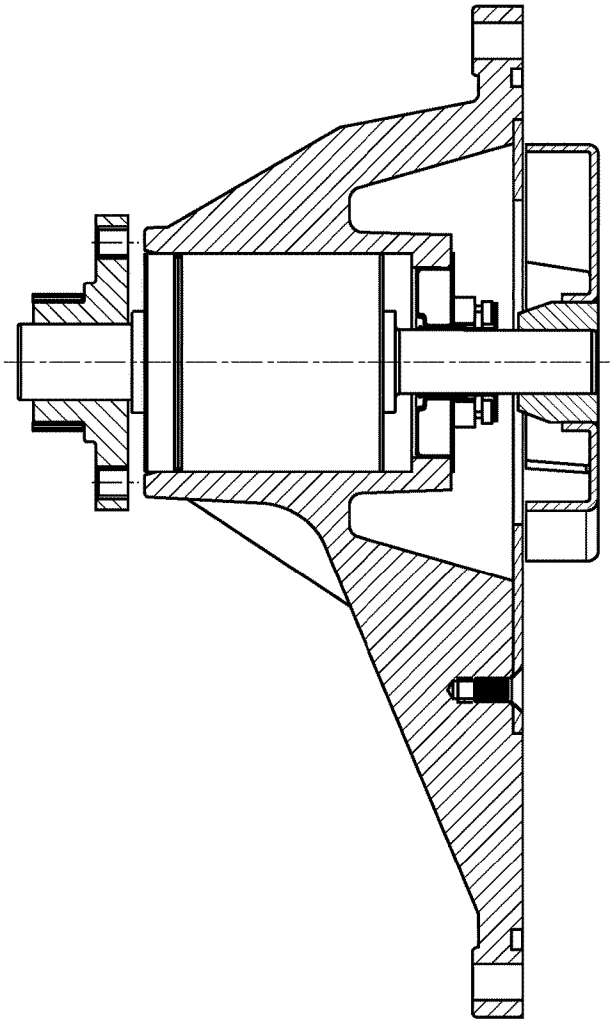
FIG. 14C illustrates an alternate view of the water pump assembly illustrated in FIG. 14A.
Figure 15A:
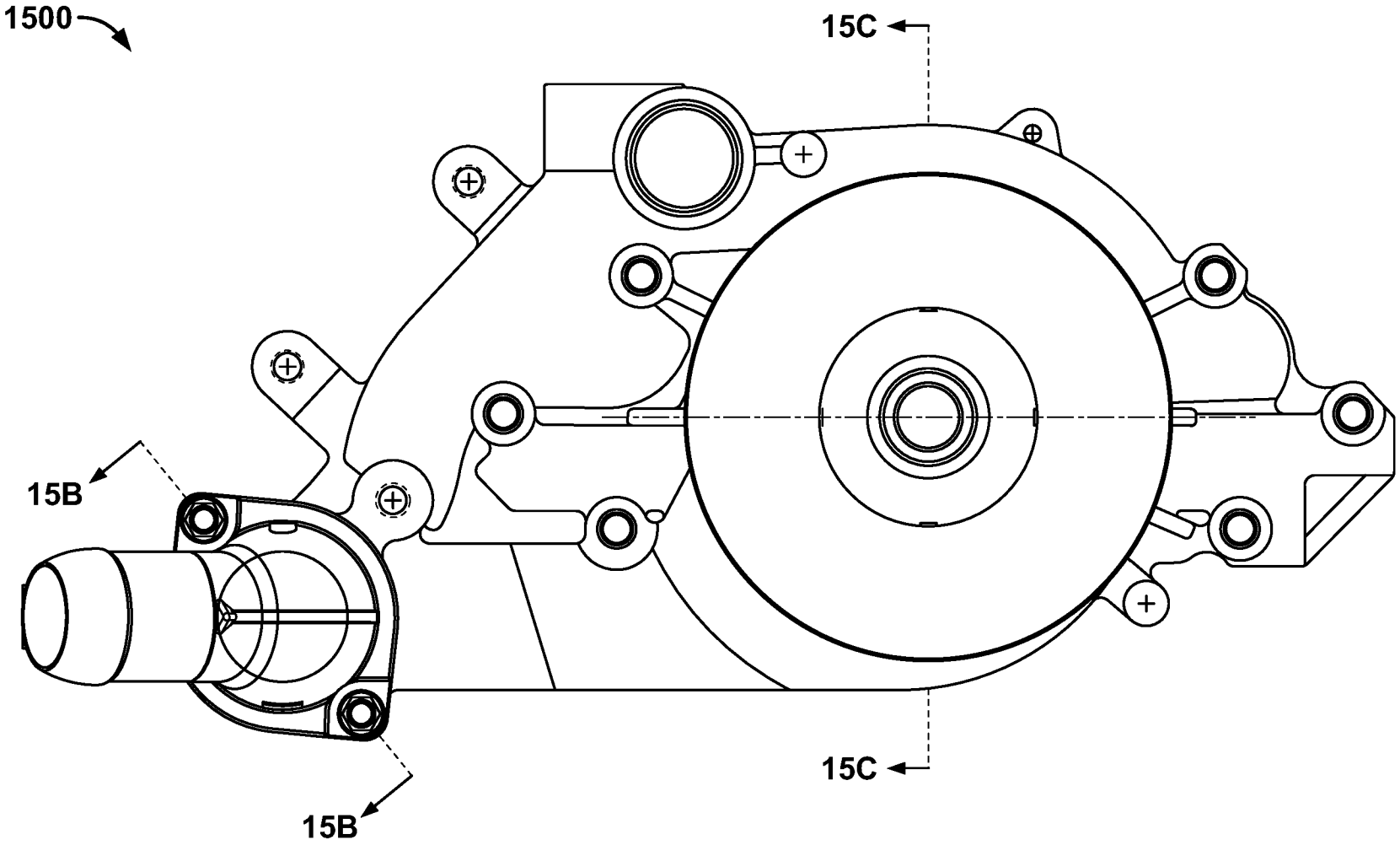
FIG. 15A illustrates an alternative water pump assembly according to certain embodiments.
Figure 15C:
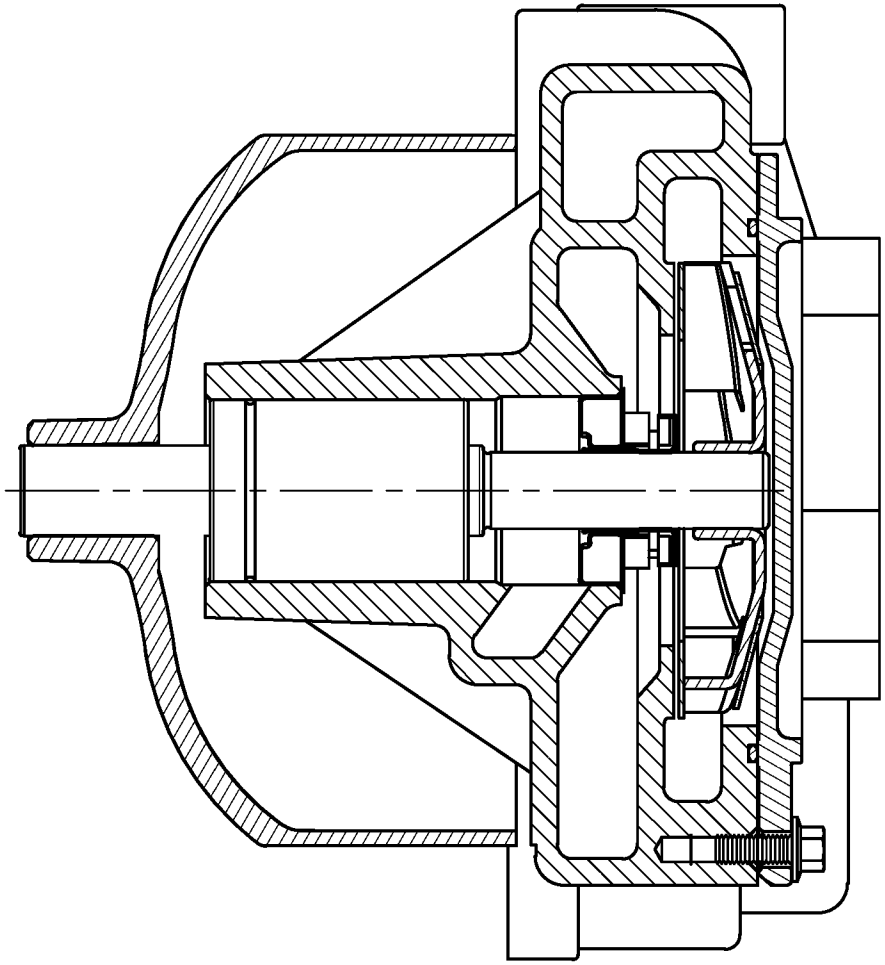
FIG. 15C illustrates an alternate view of the water pump assembly illustrated in FIG. 15A.
Figure 15B:
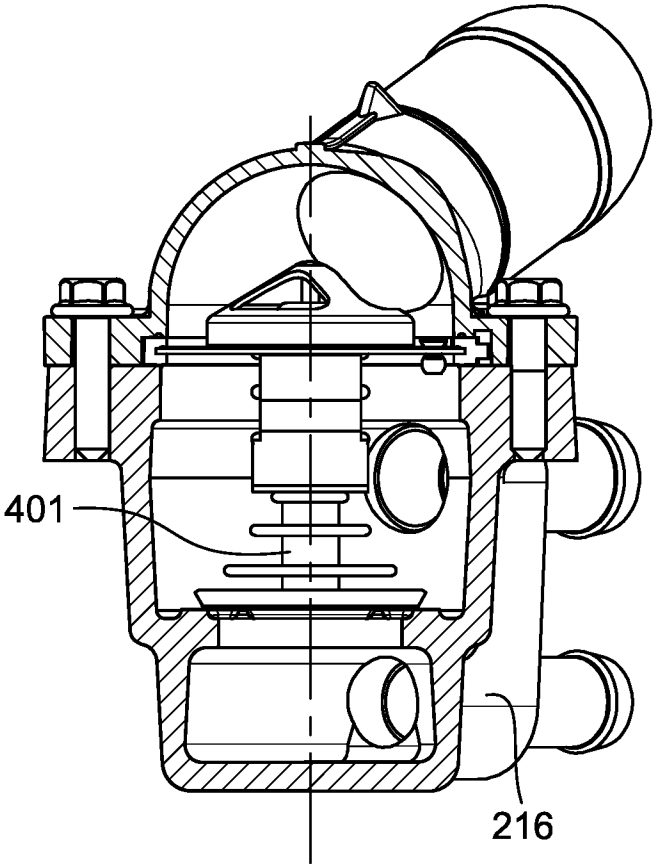
FIG. 15B illustrates an alternate view of the water pump assembly illustrated in FIG. 15A.

FIGS. 1A-1B and 2A-2B disclose exemplary water pump assemblies 100 according to certain embodiments. FIGS. 1A-1B disclose an exemplary water pump assembly 100 in which a portion of components are pre-installed and/or pre-mounted on the water pump assembly 100 using a retainer structure 130 and a portion of components are integrated directly into a body portion 110 of the water pump assembly 100. FIGS. 2A-2B disclose an exemplary water pump assembly 100 in which all components are integrated directly into a body portion 110 of the water pump assembly 100. FIGS. 3A-3F disclose an exemplary water pump assembly 100 having an integrated and/or pre-installed thermostat in accordance with certain embodiments. FIGS. 4A-4I disclose an exemplary thermostat that includes a temperature-controlled valve assembly 400 according to certain embodiments. FIGS. 5A-5E disclose a second exemplary thermostat that includes a temperature-control valve assembly 500 according to certain embodiments. FIGS. 6A-6D disclose a third exemplary thermostat that includes a temperature-control valve assembly 600 according to certain embodiments. FIGS. 7A-7B disclose a fourth exemplary thermostat includes a temperature-control valve assembly 700 according to certain embodiments. FIGS. 8A-8B disclose another exemplary water pump assembly 800 according to certain embodiments. FIGS. 9A-9B disclose another exemplary water pump assembly 900 according to certain embodiments. FIGS. 10A-10B disclose another exemplary water pump assembly 1000 according to certain embodiments. FIGS. 11A-11B disclose another exemplary water pump assembly 1100 according to certain embodiments. FIGS. 12A-12E disclose another exemplary water pump assembly 1200 according to certain embodiments. FIGS. 13A-13D disclose another exemplary water pump assembly 1300 according to certain embodiments. FIGS. 14A-14D disclose another exemplary water pump assembly 1400 according to certain embodiments. FIGS. 15A-15C disclose another exemplary water pump assembly 1500 according to certain embodiments.

The exemplary water pump assemblies disclosed in these figures are not intended to be limiting in any manner whatsoever. Additionally, any feature, component, and/or structure described for one embodiment can be incorporated into, or combined with, any other embodiment described herein. Numerous modifications can be made to the water pump assemblies as described in this disclosure. Any feature described for one embodiment of a water pump assembly can be incorporated into any other embodiment disclosed herein. Additionally, other configurations of the temperature controlled valve assembly also may be incorporated into the water pump assemblies.

In FIGS. 1A-1B, a retainer structure 130 is utilized to attach and/or secure a first set of fasteners 120 (e.g., threaded screws and/or bolts) to a lower section of the body portion 110 included in the water pump assembly 100. Openings 135 included in the retainer structure 130 are aligned with openings in the body portion 110 of the water pump assembly 100, and the fasteners 120 are inserted through the openings during assembly of the water pump assembly. In scenarios in which the fasteners 120 include threaded portions, the openings 135 in the retainer structure 130 and/or body portion 110 can be outfitted with corresponding threaded portions for receiving and securing the fasteners 120. A second set of fasteners 120 are directly integrated into an upper section of the body portion 110 included in the water pump assembly 100. The upper section includes openings for receiving the second set of fasteners 120, and the fasteners are inserted through the openings during assembly of the water pump assembly.

In FIGS. 2A-2B, a plurality of fasteners 120 are integrated into a lower section of the body portion 110 of the water pump assembly 100. In scenarios in which the fasteners 120 include threaded portions, the openings 135 in the body portion 110 can be outfitted with corresponding threaded portions for receiving and securing the fasteners 120, and the fasteners 120 are inserted through the openings during assembly of the water pump assembly. FIG. 2B also demonstrates that the water assembly includes a gasket 140 that can be pre-installed and/or pre-mounted to a bottom surface of the water pump assembly.

Figure 3A:
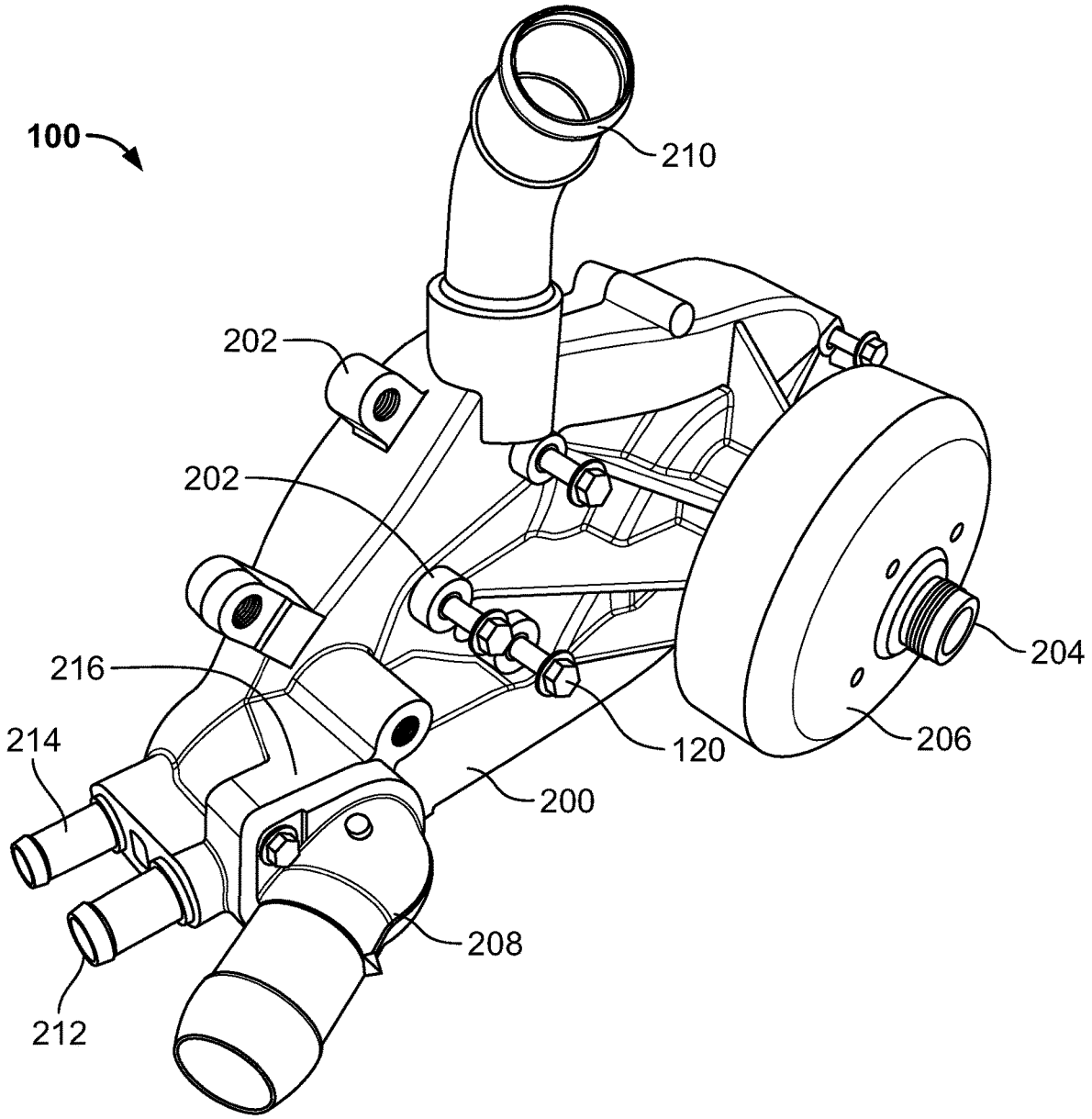
FIG. 3A illustrates an exemplary water pump assembly in accordance with certain embodiments.
Figure 3B:
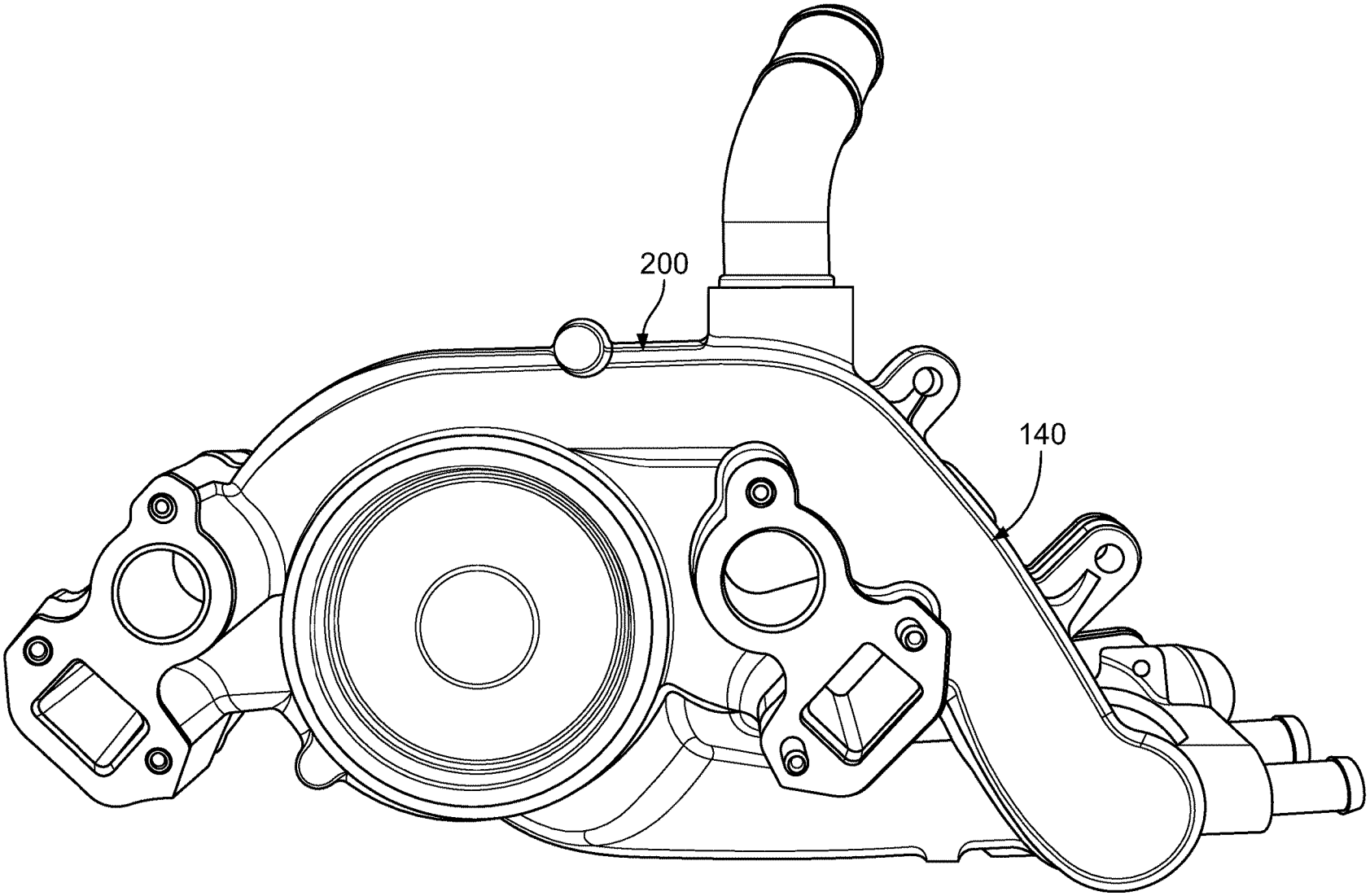
FIG. 3B illustrates an alternate view of the exemplary water pump assembly illustrated in FIG. 3A.

Turning to FIGS. 3A-3B, an exemplary water pump assembly 100 is illustrated comprising a housing 200. The water pump assembly 100 includes a plurality of pre-mounted fasteners 120 connected to the housing 200 of the water pump assembly 100. The plurality of pre-mounted fasteners 120 enable connection of the housing 200 to an engine assembly.

In some embodiments, a thermostat 401 is integrated into the housing 200 of the water pump assembly 100. As described in more detail below, the thermostat 401 can include a temperature-controlled valve assembly 400 configured to regulate a flow of coolant to the engine assembly.

The water pump assembly 100 also can include one or more pre-mounted gaskets 140. The one or more pre-mounted gaskets 140 are connected to an exterior of the housing and are adapted to seal a connection between the housing of the water pump assembly 100 and the engine assembly. An exterior surface of the housing 200 comprises a plurality of fastener connection structures 202. The plurality of fastener connection structures 202 include openings for receiving the plurality of pre-mounted fasteners 120. The plurality of pre-mounted fasteners 120 are pre-installed in the openings of the plurality of fastener connection structures 202. The water pump assembly 100 can include one or more retainer structures 130 connected to an exterior surface of the housing 200. In some cases, the one or more retainer structures 130 are adapted to receive the plurality of pre-mounted fasteners 120 and connect the plurality of pre-mounted fasteners 120 to the housing 200.

Figure 3C:
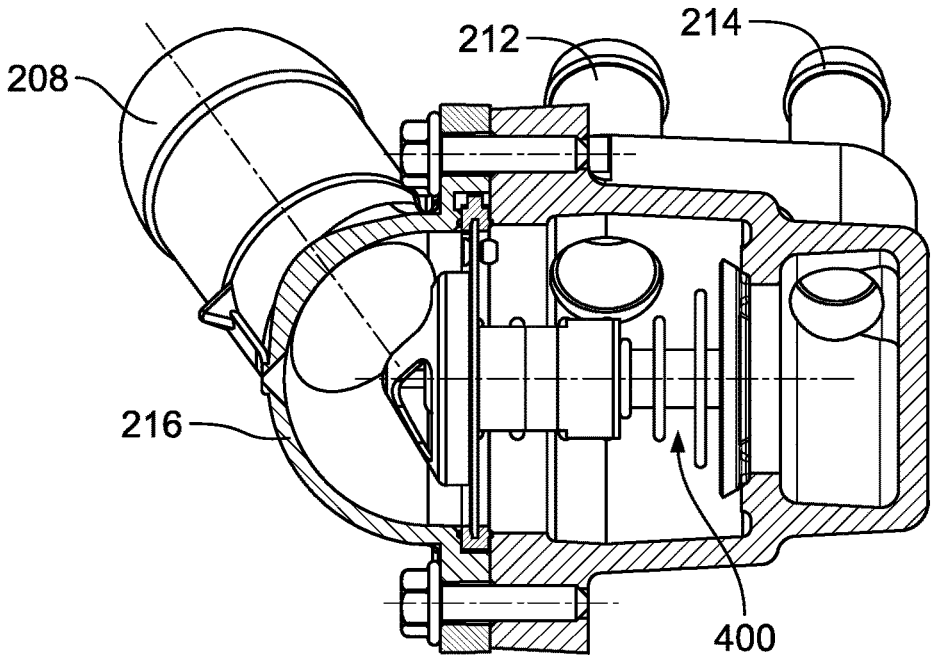
FIG. 3C illustrates an alternate view of the exemplary water pump assembly illustrated in FIG. 3A.
Figure 3D:
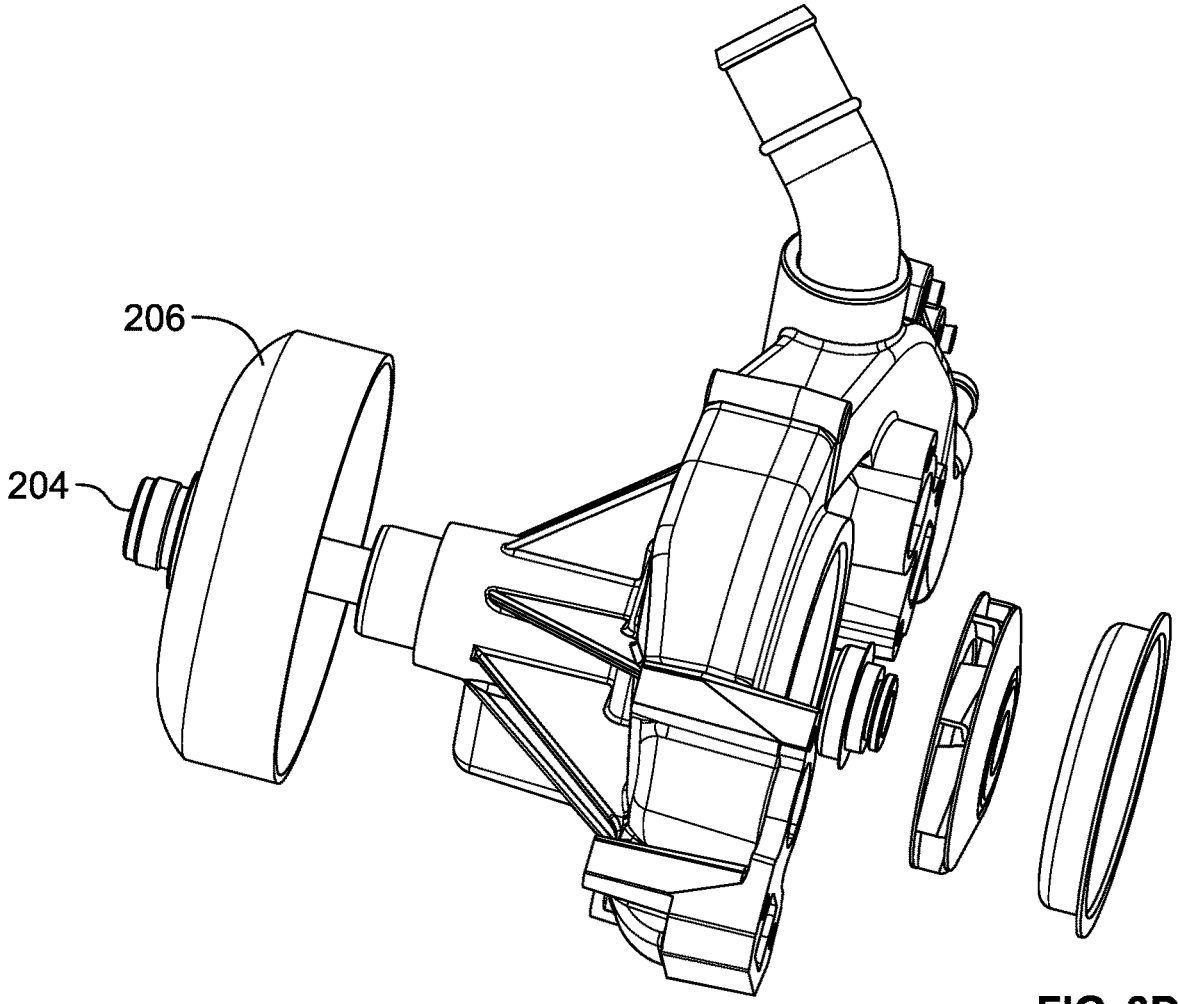
FIG. 3D illustrates an alternate view of the exemplary water pump assembly illustrated in FIG. 3A.
Figure 3E:
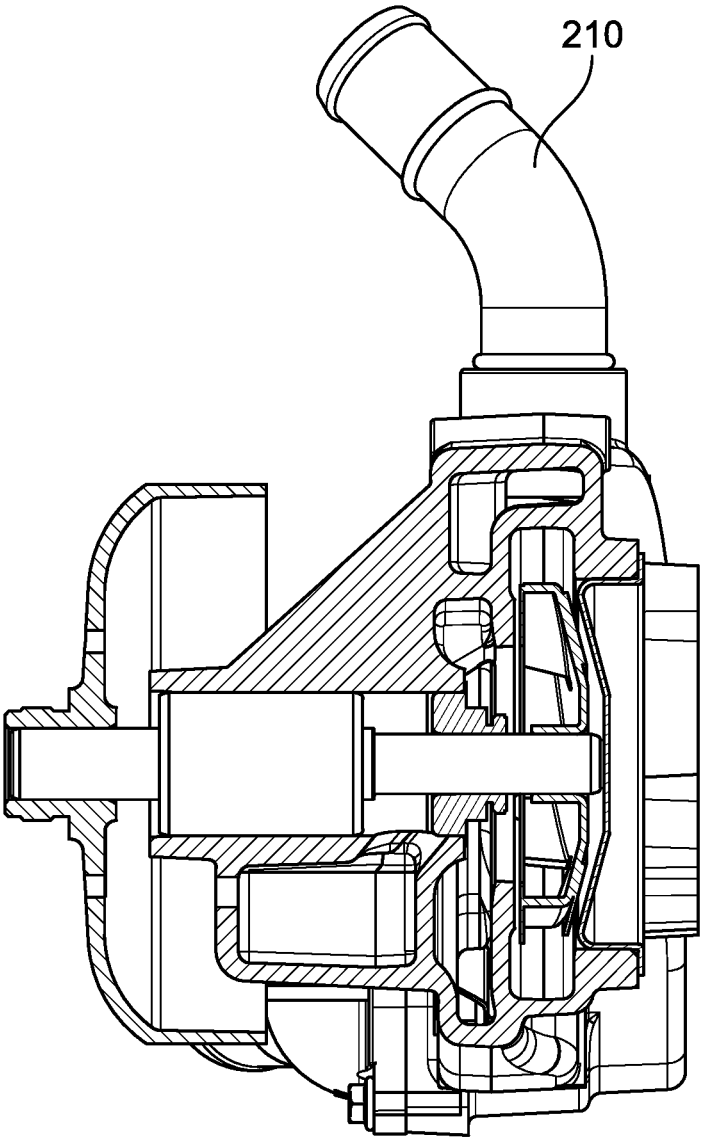
FIG. 3E illustrates an alternate view of the exemplary water pump assembly illustrated in FIG. 3A.
Figure 3F:
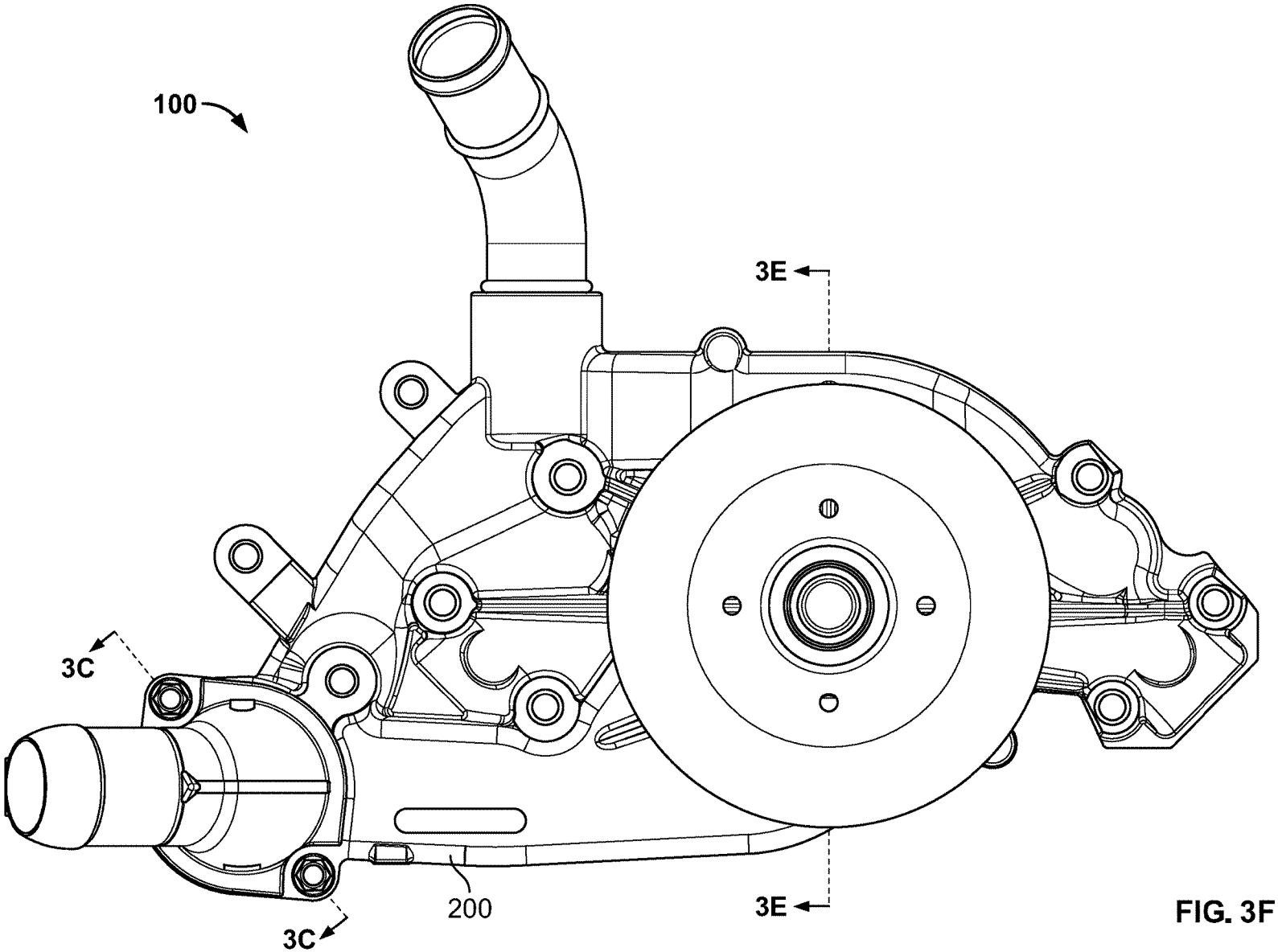
FIG. 3F illustrates an alternate view of the exemplary water pump assembly illustrated in FIG. 3A.
Figure 4A:
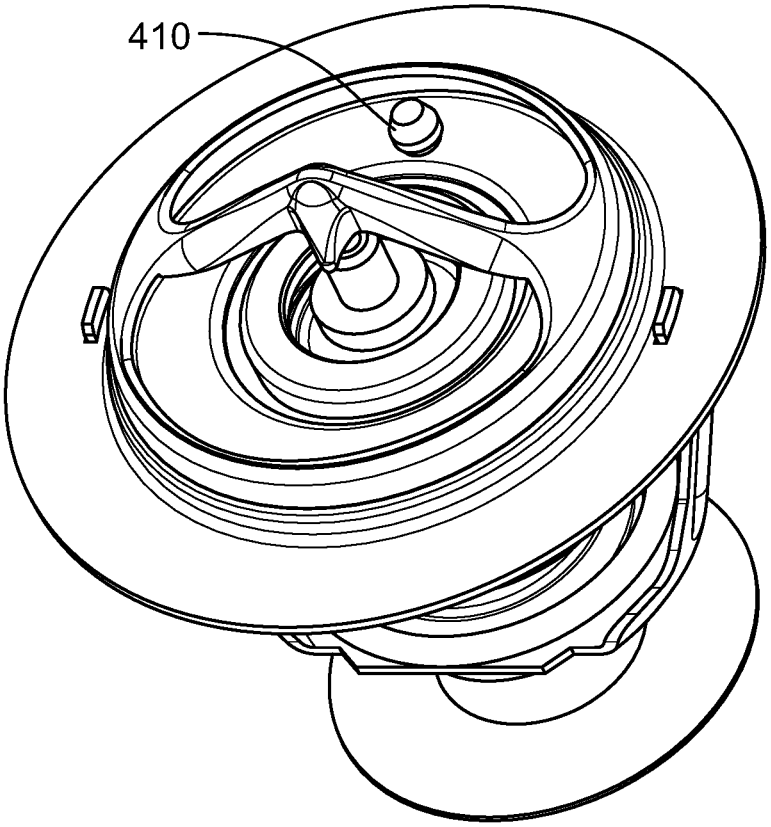
FIG. 4A illustrates an exemplary temperature-controlled valve assembly according to certain embodiments.
Figure 4B:
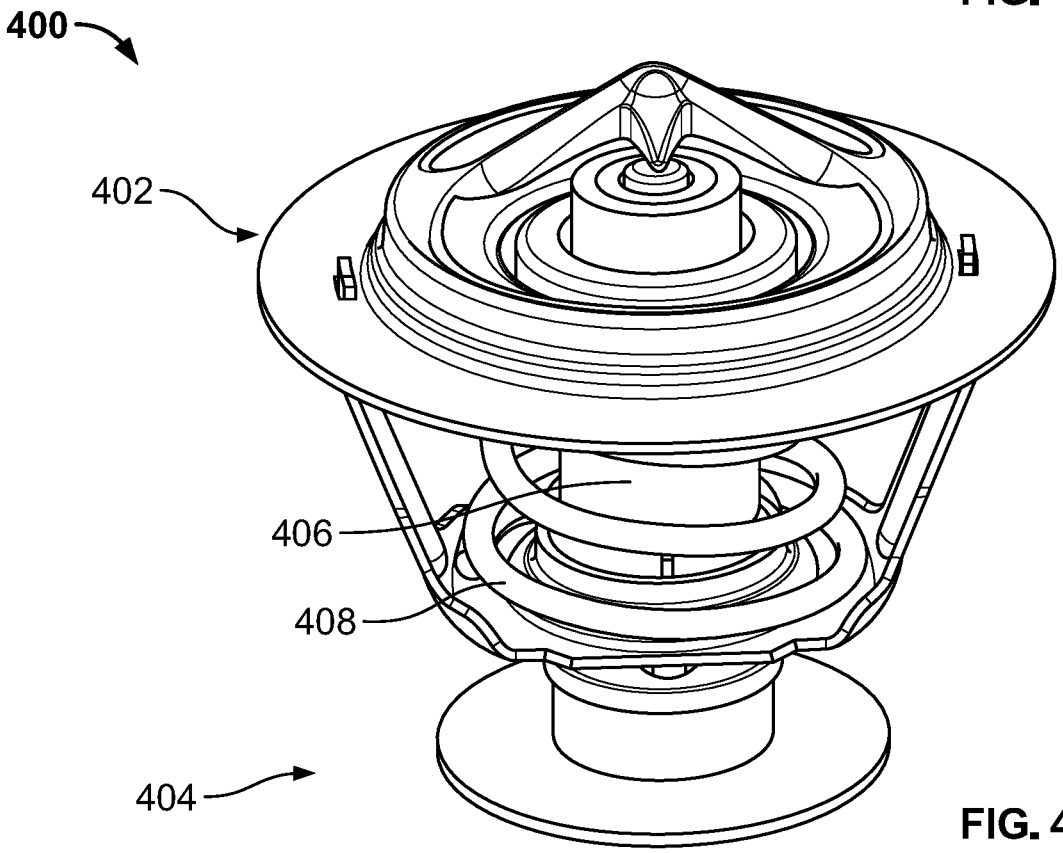
FIG. 4B illustrates an alternate view of the exemplary temperature-controlled valve assembly illustrated in FIG. 4A.
Figure 4C:
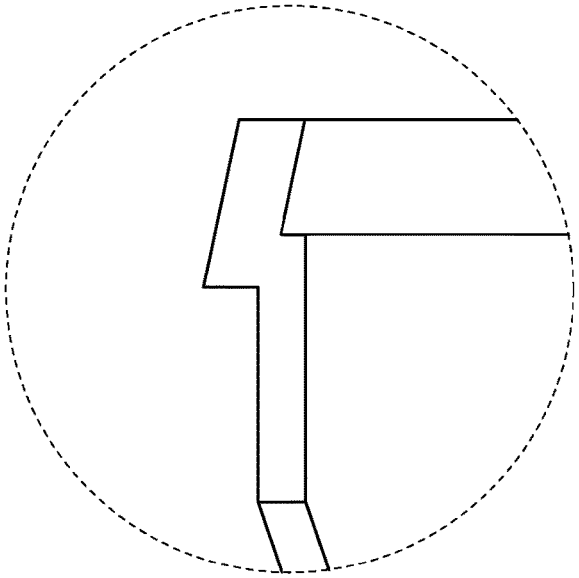
FIG. 4C illustrates an alternate view of the exemplary temperature-controlled valve assembly illustrated in FIG. 4A.
Figure 4D:
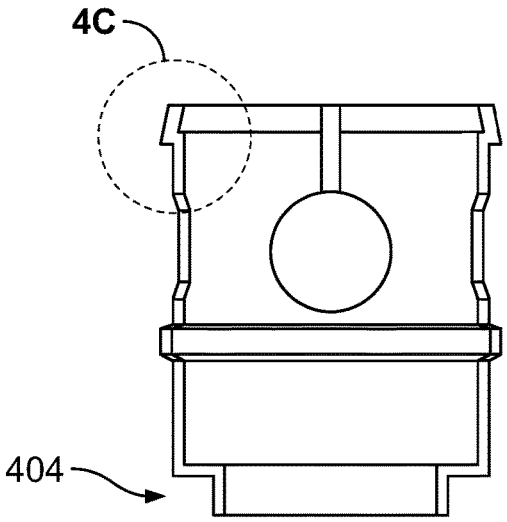
FIG. 4D illustrates an alternate view of the exemplary temperature-controlled valve assembly illustrated in FIG. 4A.
Figure 4E:
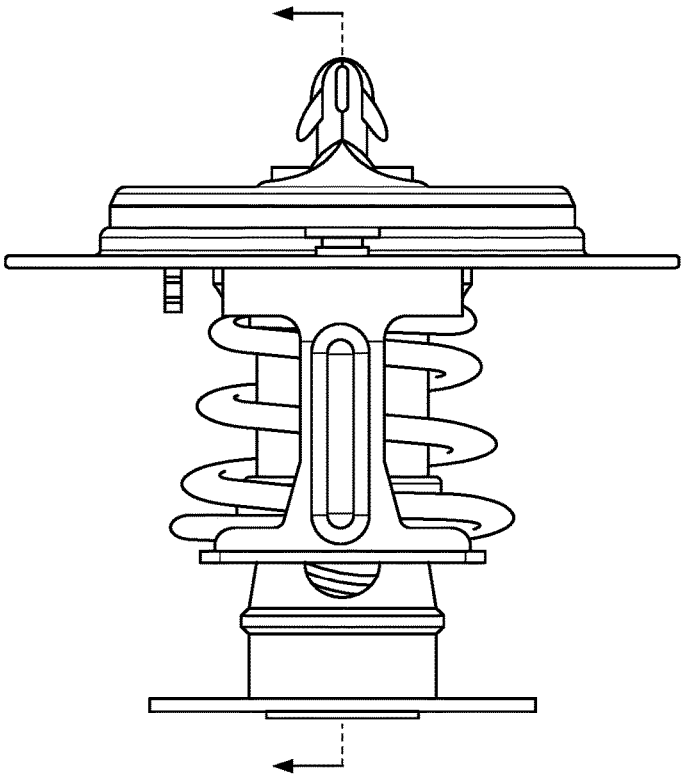
FIG. 4E illustrates an alternate view of the exemplary temperature-controlled valve assembly illustrated in FIG. 4A.
Figure 4F:
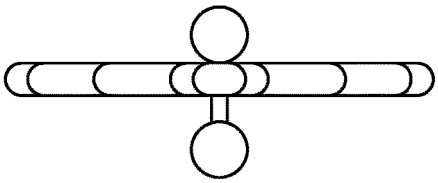
FIG. 4F illustrates an alternate view of the exemplary temperature-controlled valve assembly illustrated in FIG. 4A.
Figure 4G:
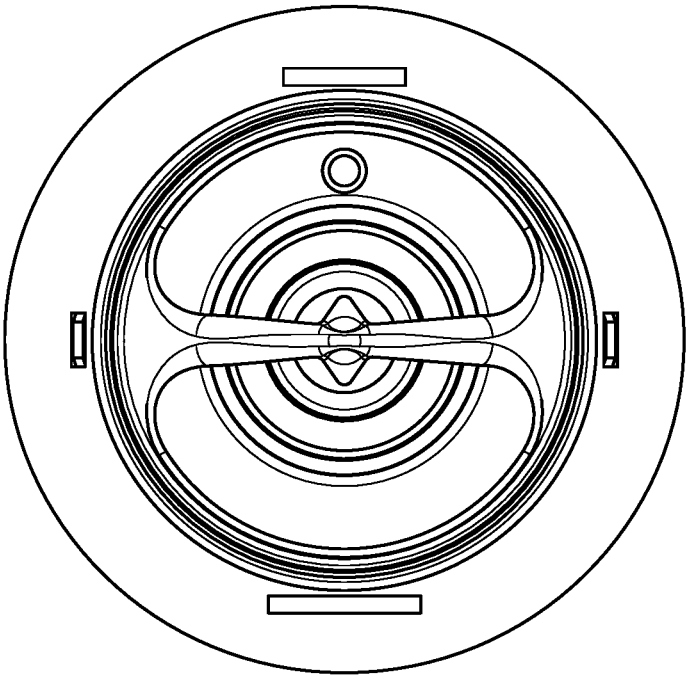
FIG. 4G illustrates an alternate view of the exemplary temperature-controlled valve assembly illustrated in FIG. 4A.
Figure 4H:
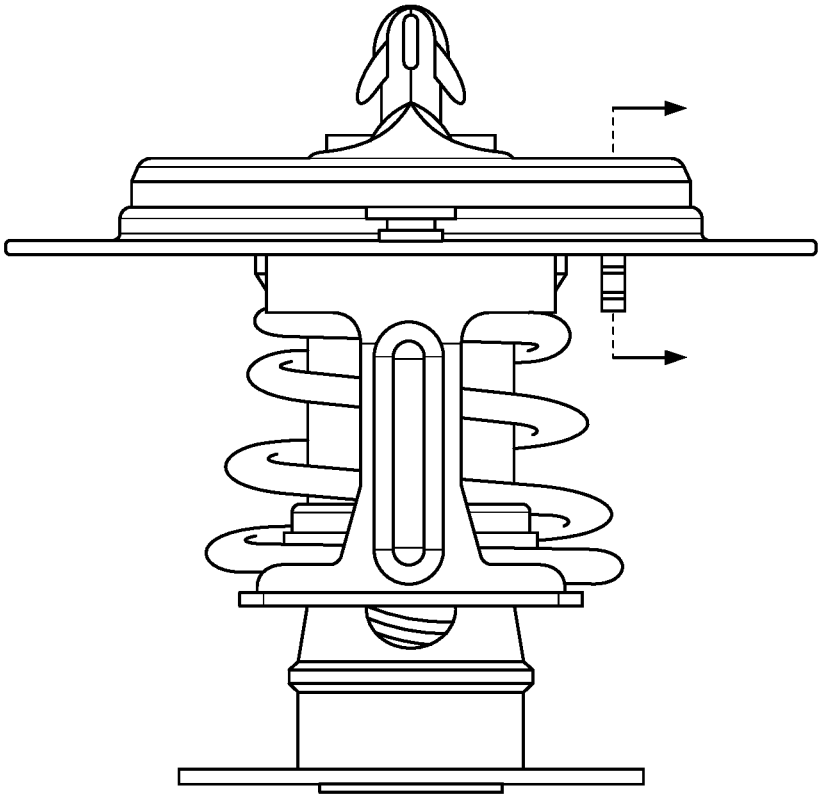
FIG. 4H illustrates an alternate view of the exemplary temperature-controlled valve assembly illustrated in FIG. 4A.
Figure 4I:
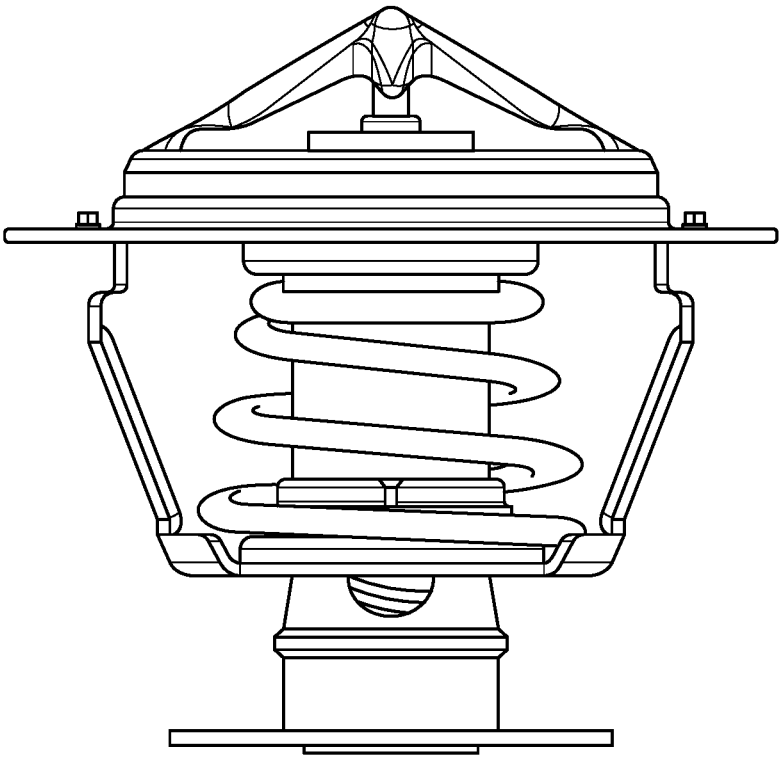
FIG. 4I illustrates an alternate view of the exemplary temperature-controlled valve assembly illustrated in FIG. 4A.
Figure 4J:
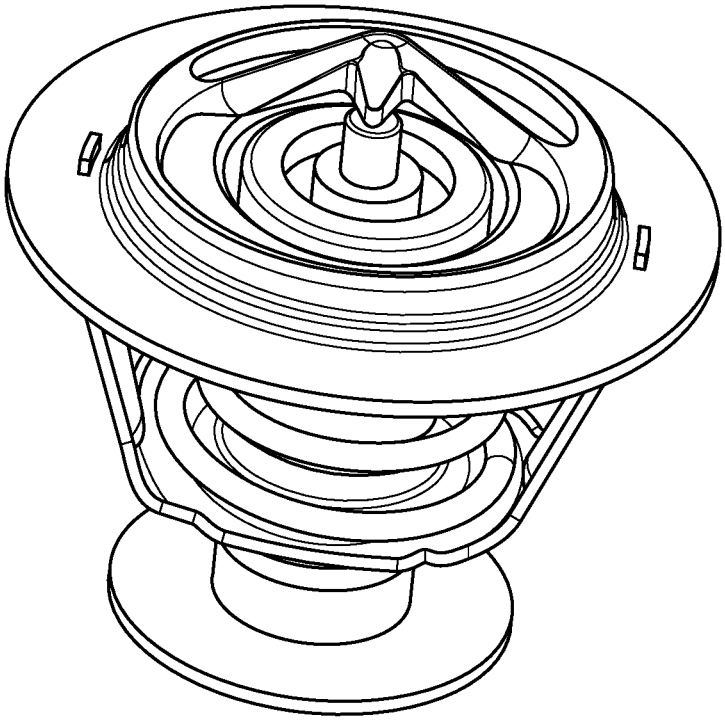
FIG. 4J illustrates an alternate view of the exemplary temperature-controlled valve assembly illustrated in FIG. 4A.
Figure 4K:
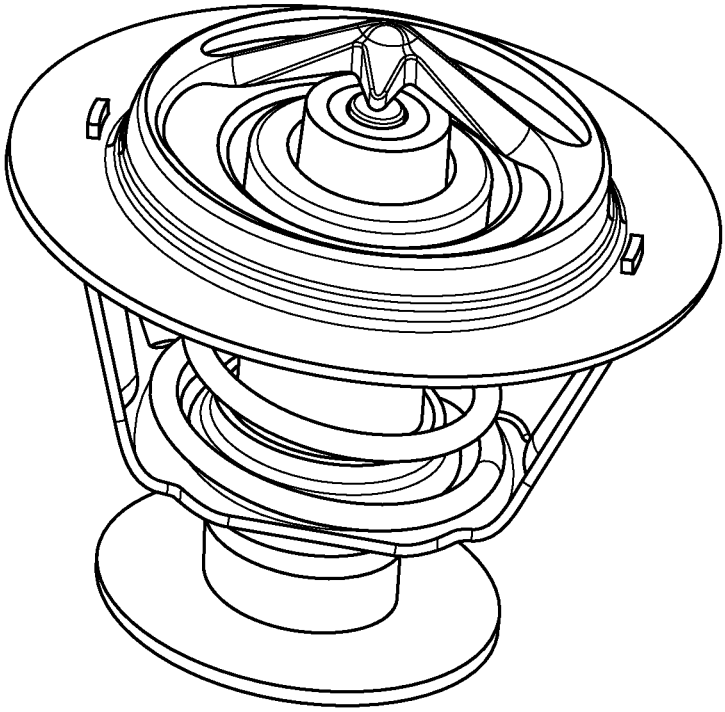
FIG. 4K illustrates an alternate view of the exemplary temperature-controlled valve assembly illustrated in FIG. 4A.
Figure 5A:
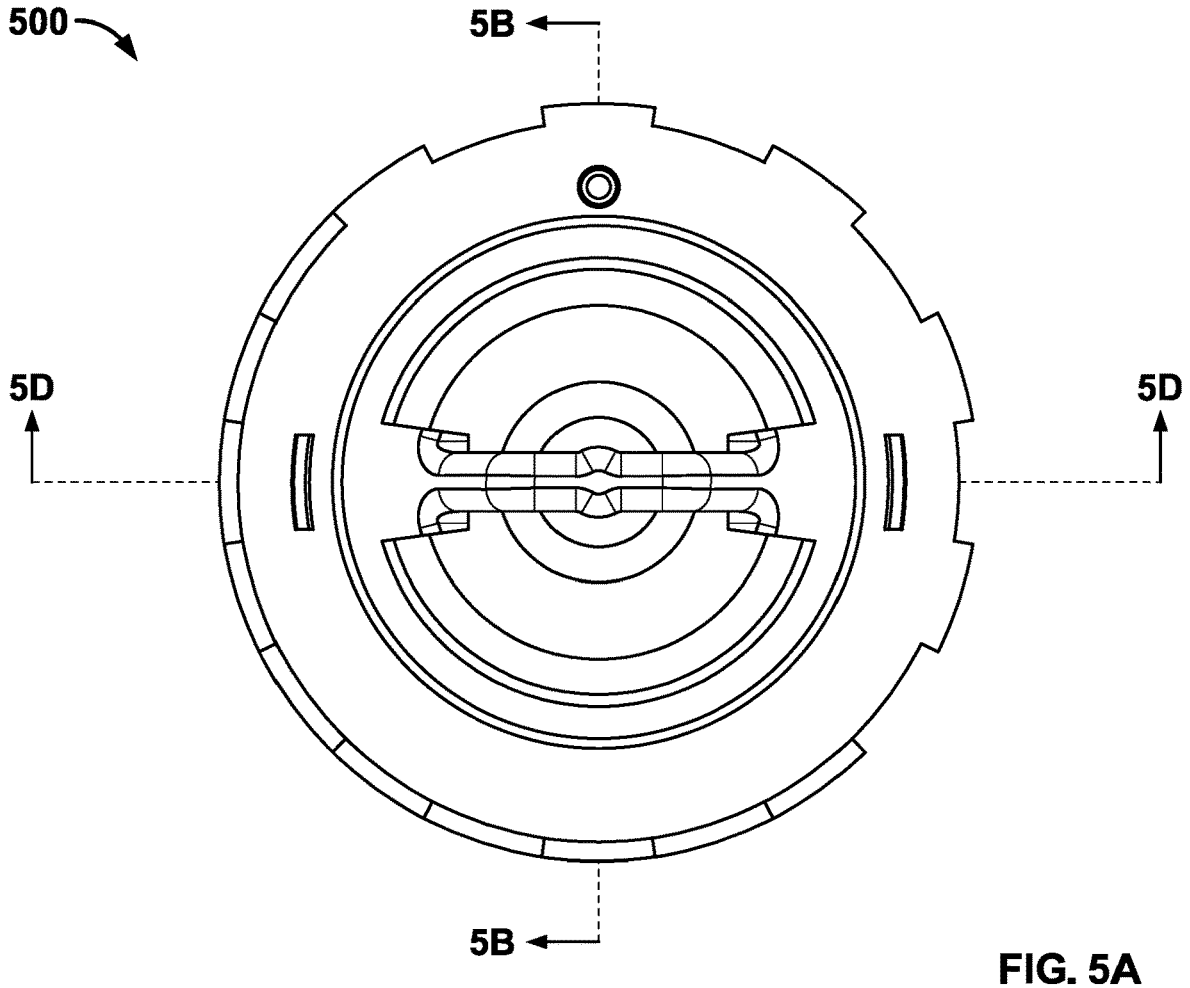
FIG. 5A illustrates an alternative temperature-control valve assembly according to certain embodiments.
Figure 5B:
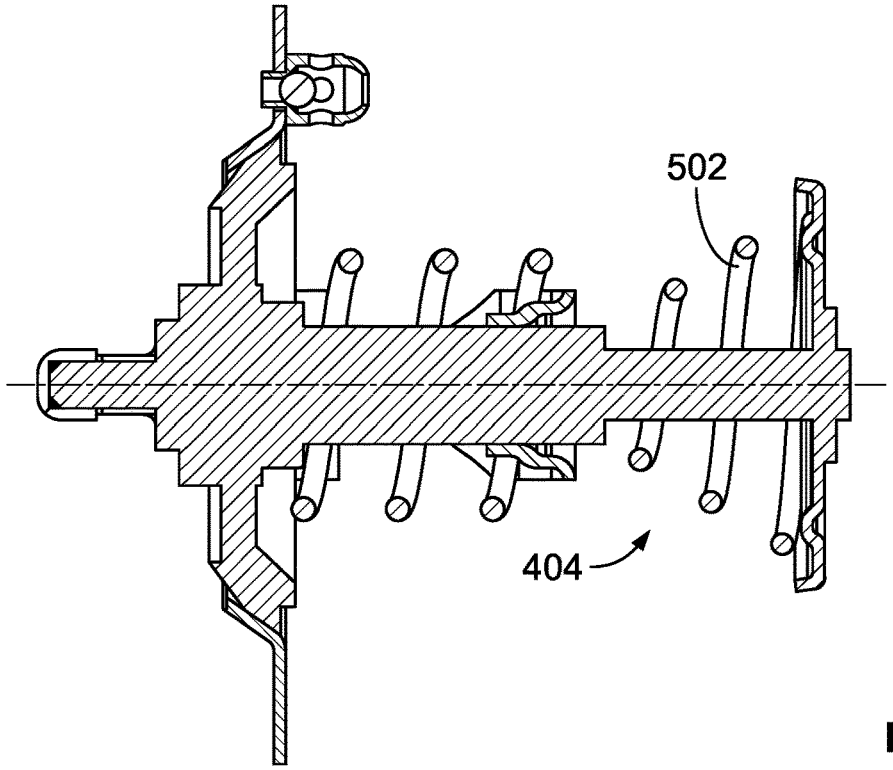
FIG. 5B illustrates an alternate view of the temperature-controlled valve assembly illustrated in FIG. 5A.
Figure 5C:
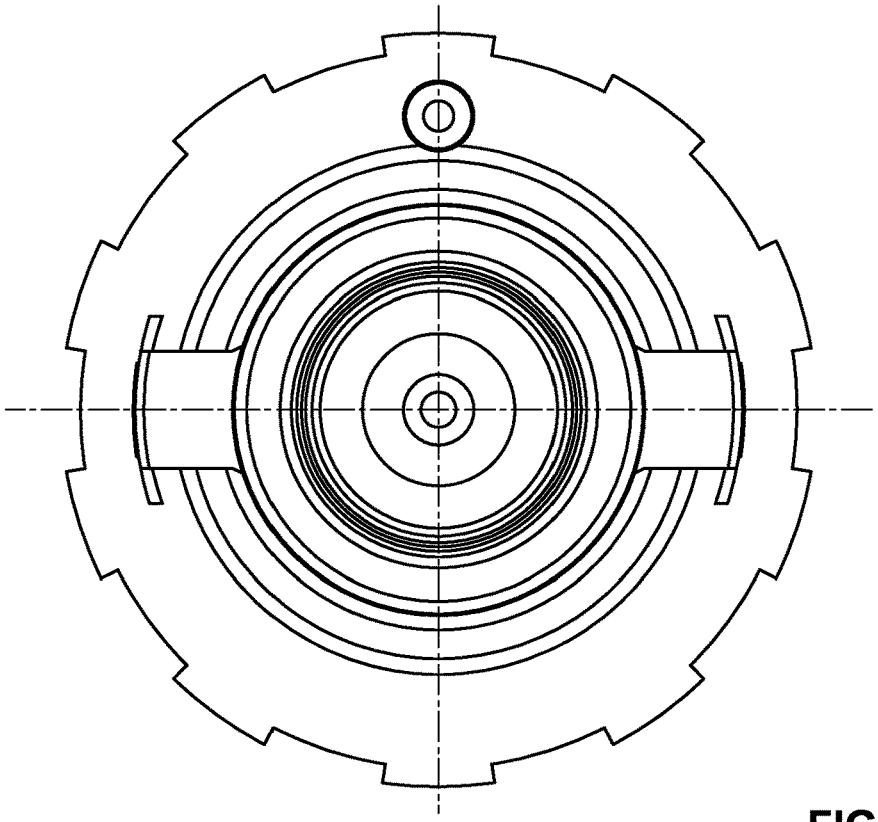
FIG. 5C illustrates an alternate view of the temperature-controlled valve assembly illustrated in FIG. 5A.
Figure 5D:
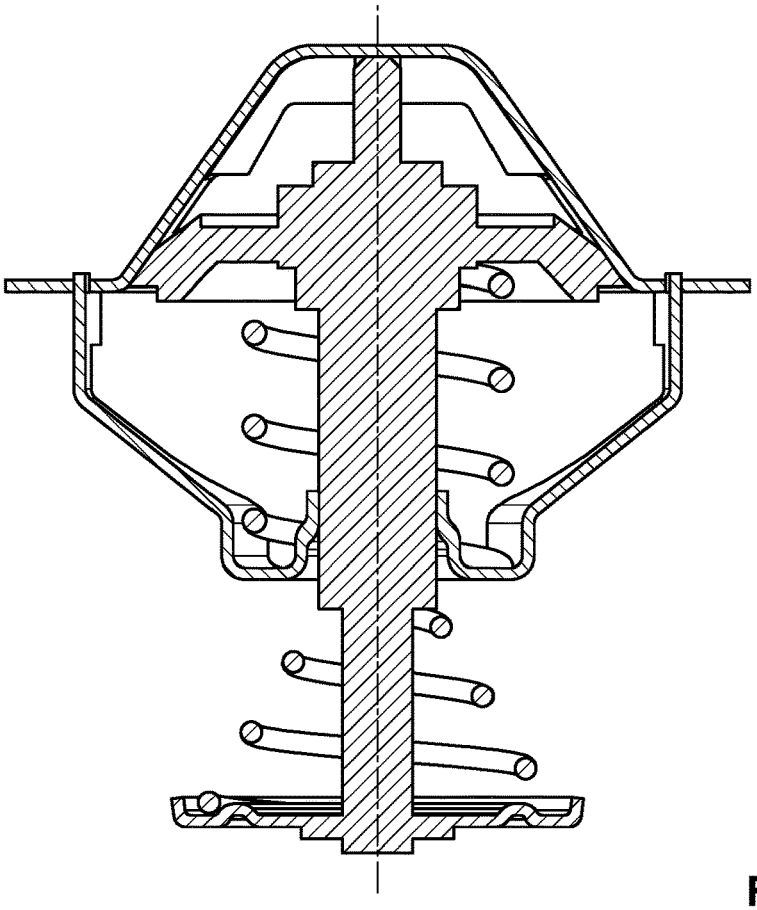
FIG. 5D illustrates an alternate view of the temperature-controlled valve assembly illustrated in FIG. 5A.
Figure 5E:
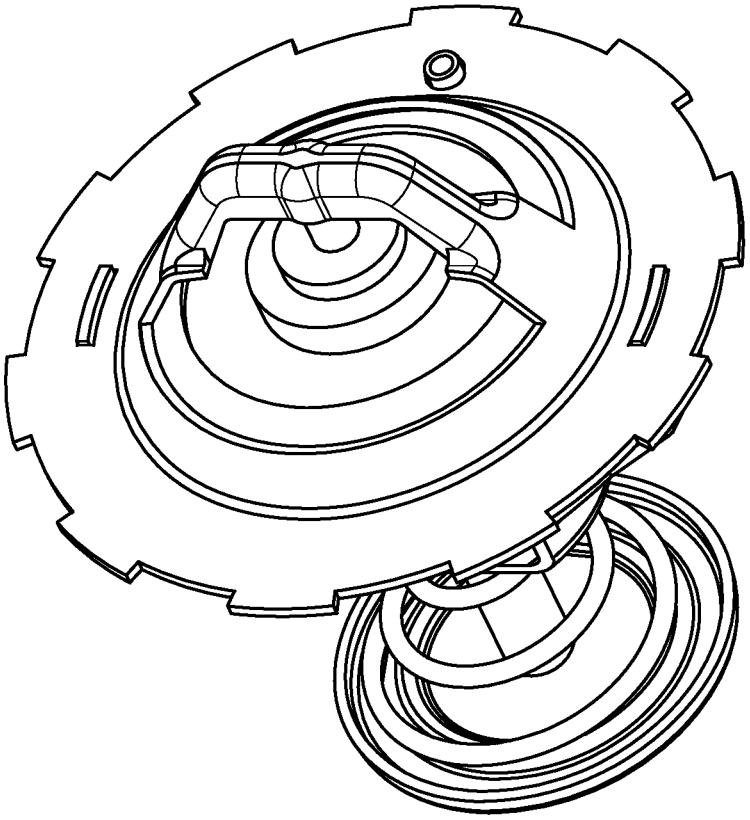
FIG. 5E illustrates an alternate view of the temperature-controlled valve assembly illustrated in FIG. 5A.
Figure 6A:
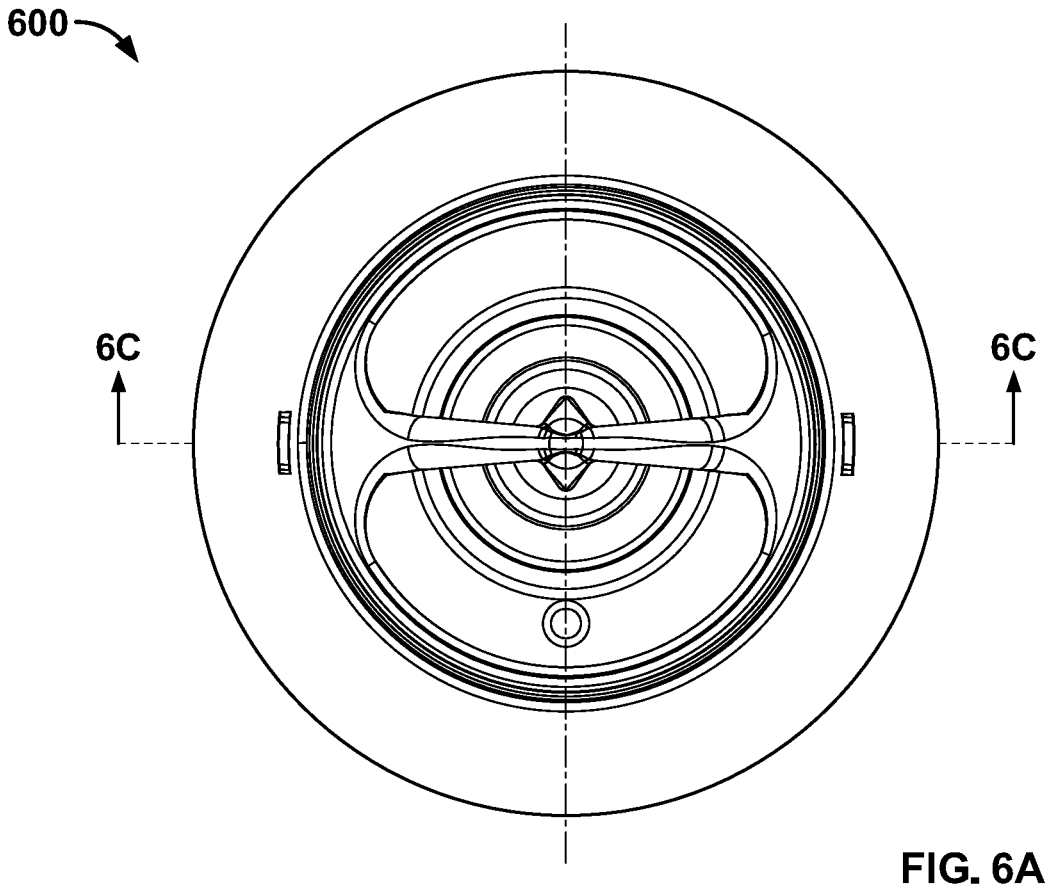
FIG. 6A illustrates an alternative temperature-control valve assembly according to certain embodiments.
Figure 6B:
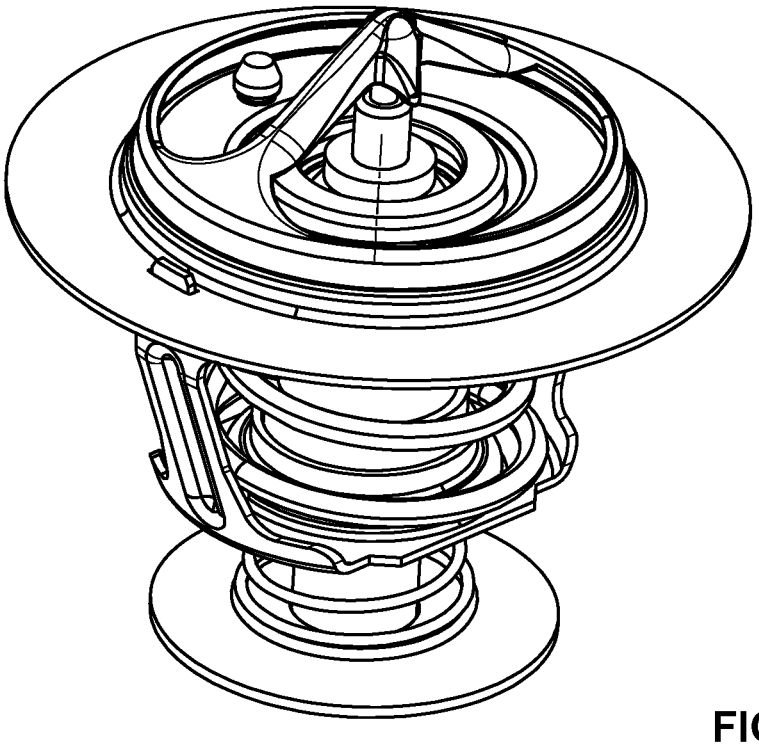
FIG. 6B illustrates an alternate view of the temperature-controlled valve assembly illustrated in FIG. 6A.
Figure 6C:
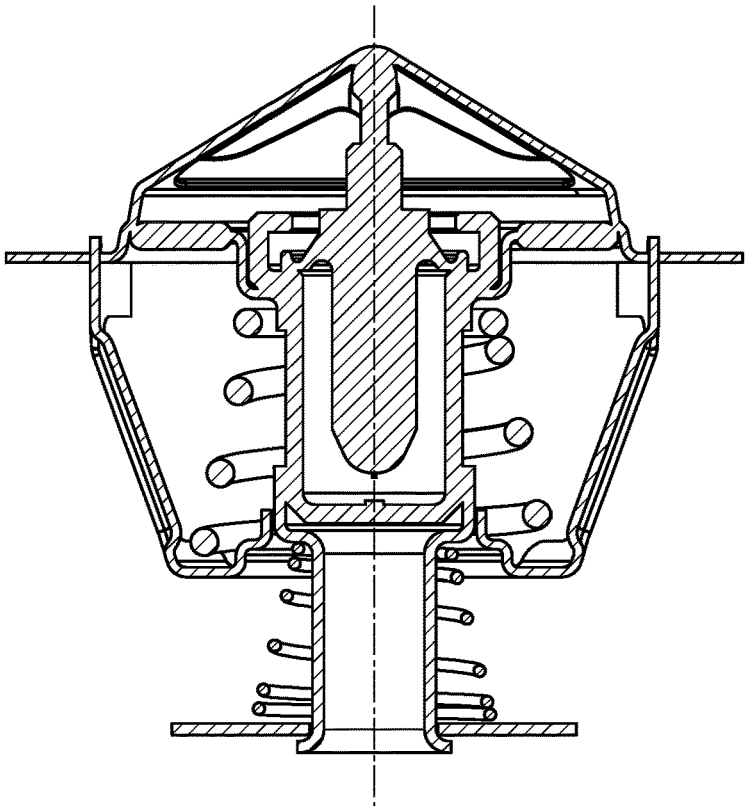
FIG. 6C illustrates an alternate view of the temperature-controlled valve assembly illustrated in FIG. 6A.
Figure 6D:
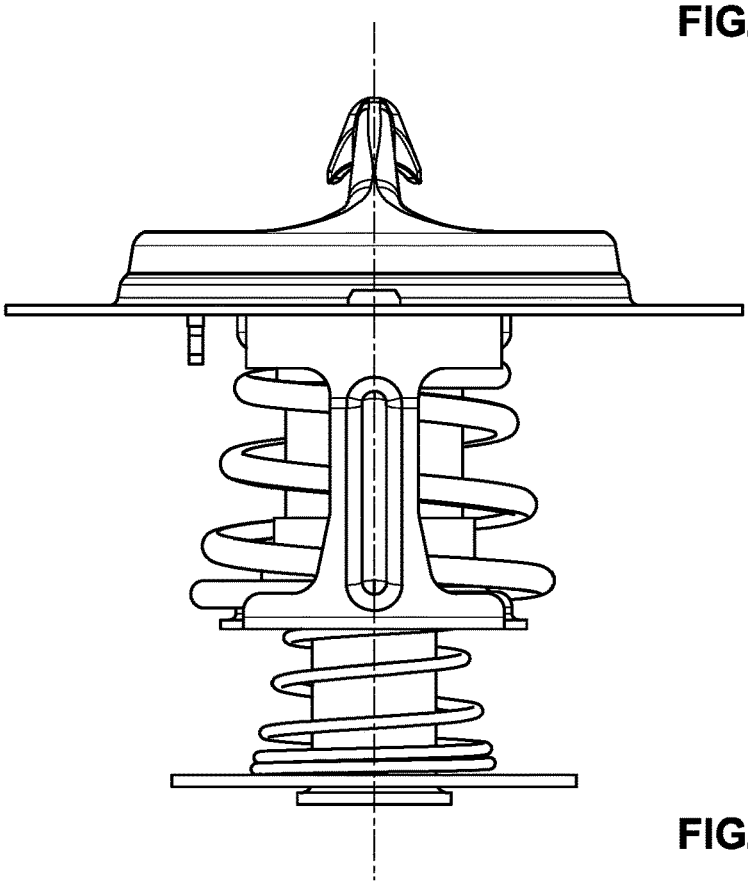
FIG. 6D illustrates an alternate view of the temperature-controlled valve assembly illustrated in FIG. 6A.

As illustrated in FIGS. 3A-3F, the water pump assembly 100 can include a bearing 204 coupled to the housing 200, and a pulley 206 coupled to the bearing 204. The bearing 204 and the pulley 206 are adapted to be coupled to the engine assembly to operate the water pump assembly 100. The water pump assembly 100 includes a feed line 208, a return line 210 that are adapted to be coupled to a radiator. The water pump assembly 100 also includes an inlet 212 and an outlet 214 that are adapted to be coupled to a heater core. The water pump assembly 100 includes a thermostat housing 216 that houses a thermostat 401. The thermostat 401 includes a temperature-controlled valve assembly 400 that operates to redirect coolant from the water pump assembly 100 to a radiator and/or engine assembly. The thermostat housing 216 is adjacent to the feed line 208 to facilitate the redirection of the coolant to the radiator. FIG. 3C illustrates a cross section view of the temperature-control valve assembly 400 positioned in the thermostat housing 216 of the water pump assembly 100.

In certain embodiments, the water pump assemblies 100 in FIGS. 1A-1B, 2A-2B, and 3A-3F (or other embodiments disclosed herein) can include other components, such as one or more gasket removers, one or more thermostats, one or more thermal sensors, and/or other components. Some or all of these components can be integrated into body portions 110 of the water pump assemblies 100 and/or retainer structures 130 attached to the water pump assembly 100. Some or all of these components can be pre-packaged with the water pump assemblies 100.

Turning to FIGS. 4A-4I, a thermostat 401 comprising a temperature-controlled valve assembly 400 is illustrated. The temperature-controlled valve assembly 400 includes a primary valve 402 and a bypass valve 404. The primary valve 402 is configured to transition between an open position and a closed position within the housing 200 of the water pump assembly 100 to direct the flow of coolant either directly to an engine assembly or indirectly to the engine assembly via a radiator assembly included in a vehicle's cooling system.

The primary valve 402 is adapted to be in the closed position when the temperature of an engine assembly is below a predetermined temperature, and the primary valve 402 transitions to the open position when the temperature of an engine assembly is above a predetermined temperature. When the primary valve 402 is arranged in the closed position, a first passageway inside the housing directs the flow of the coolant directly to the engine assembly via the bypass valve 404. In particular, the first passageway receives the flow of coolant through the inlet 212 into the housing of the water pump assembly, and then coolant passes through the bypass valve 402 and out to the engine assembly through the outlet 214. When the primary valve 402 is arranged in the open position, a second passageway inside the housing directs the flow of the coolant to a radiator assembly (e.g., to enable cooling of the coolant). In particular, the second passageway directs the flow of coolant into the housing through the inlet 212, and then the coolant flows through the opened primary valve 402, which directs the coolant through the feed line 208 to the radiator assembly.

The temperature-controlled valve assembly 400 can include the primary valve 402, the bypass valve 404, a charge cylinder 406, and a spring 408. The bypass valve 404 is located opposite the primary valve 402. The charge cylinder 406 extends between the primary valve 402 and the bypass valve 404, and the spring 408 surrounds the charge cylinder 406 (e.g., coiled around the charge cylinder 406). In some embodiments, the temperature-control valve assembly 400 also can include a bleed port 410. The bleed port 410 bleeds or sheds the water pump assembly 100 of trapped air by allowing air to pass into the radiator, thereby releasing air from building up within the water pump assembly 100. The primary valve 402, the bypass valve 404, the charge cylinder 406, the spring 408, and bleed port 410 are included, or integrated, within the housing 200 of the water pump assembly 100.

FIGS. 5A-5E illustrate another exemplary temperature-control valve assembly 500. The temperature-control valve assembly 500 operates in the same or similar manner as the aforementioned temperature control valve assembly 400.

However, in this embodiment, the temperature-control valve assembly 500 includes a second spring 502 situated on or adjacent to the bypass valve 404. Additionally, the temperature-control valve assembly 500 is dimensioned and/or designed to be incorporated into an alternate type of vehicle. 5C-5E are alternate views of the temperature-control valve assembly 500.

FIGS. 6A-6D illustrate an alternative temperature-control valve assembly 600. The temperature-control valve assembly 600 operates in the same or similar manner as the aforementioned temperature control valve assemblies (400, 500).

However, in this embodiment, the temperature-control valve assembly 600 is dimensioned and/or designed to be incorporated for an alternate type of vehicle. 6B-6D are alternate views of the temperature-control valve assembly 600.

FIGS. 7A-7B illustrate an alternative temperature-control valve assembly 700. The temperature-control valve assembly 700 operates in the same or similar manner as the aforementioned temperature control valve assemblies (400, 500, 600). Again, the temperature-control valve assembly 700 is dimensioned and/or designed to be incorporated for an alternate type of vehicle.

FIGS. 8A-8B, 9A-9B, 10A-10B, 11A-11B, 12A-12E, 13A-13D, 14A-14D, and 15A-15C other embodiments of additional water pump assemblies (800, 900, 1000, 1100, 1200, 1300, 1400, and 1500, respectively). These water pump assemblies (800, 900, 1000, 1100, 1200, 1300, 1400, and 1500) operate in the same or similar manner as the water pump assembly 100 of FIGS. 3A-3F described above, but have been adapted or dimensioned for usage in alternate types of vehicles. Each of these water pump assemblies (800, 900, 1000, 1100, 1200, 1300, 1400, and 1500) can include one or more pre-mounted fasteners 120, one or more fastener connection structures 202, and/or one more pre-mounted gaskets 140.

Moreover, each of these water pump assemblies (800, 900, 1000, 1100, 1200, 1300, 1400, and 1500) comprise an integrated or pre-installed thermostat 401, which includes one of the temperature-controlled valve assemblies 400, 500, 600, 700 having a primary valve 402 and bypass valve 404. The housings for each of these water pump assemblies (800, 900, 1000, 1100, 1200, 1300, 1400, and 1500) also includes a first passageway that directs the flow of the coolant to an engine assembly when the primary valve is in a closed position, and a second passage that directs the flow of the coolant to the radiator of a vehicle when the primary valve is in an open position.

Figure 16:
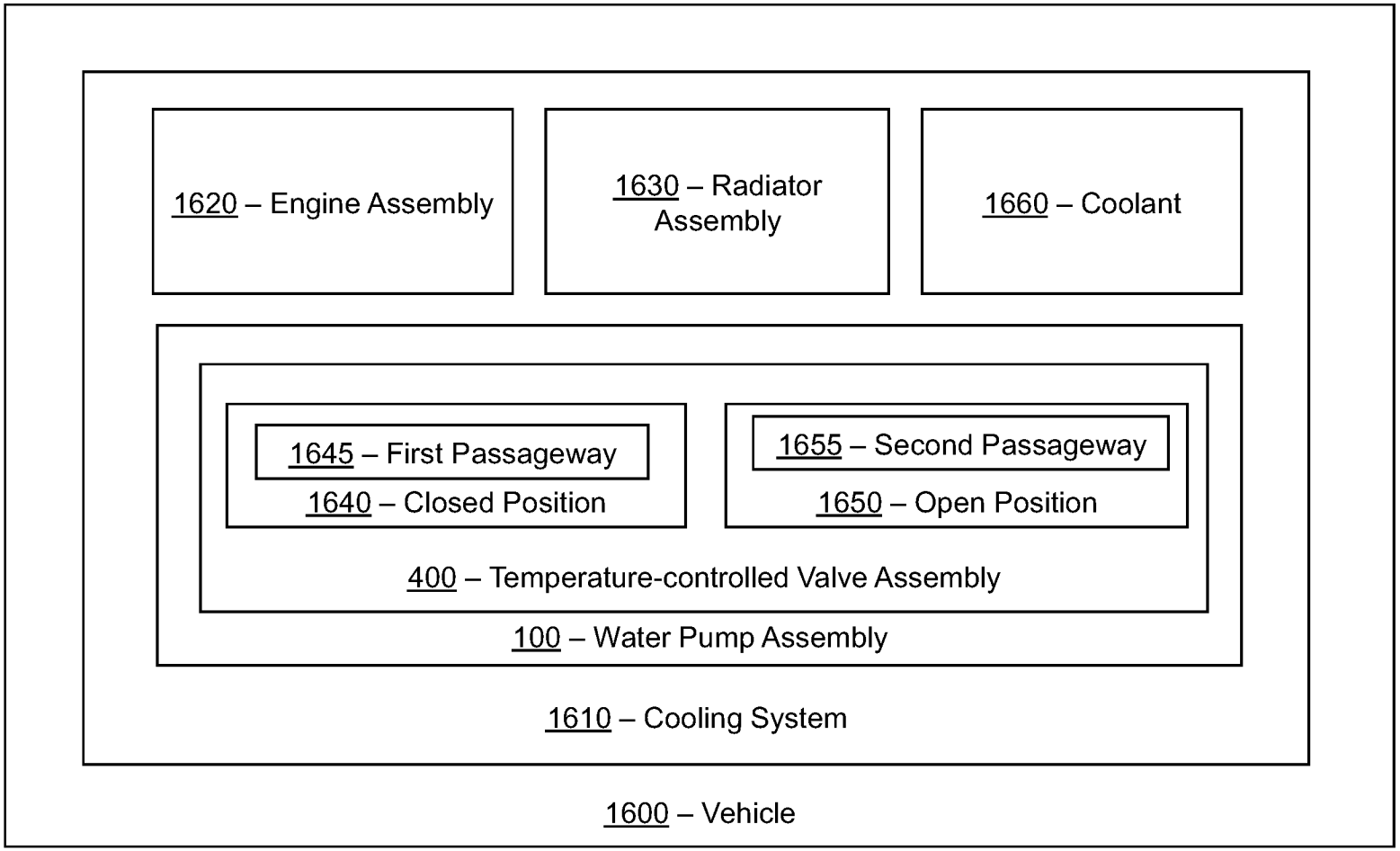
FIG. 16 is a block diagram for a cooling system in vehicle according to certain embodiments.

FIG. 16 is a block diagram illustrating an exemplary cooling system 1610 for a vehicle 1600. The cooling system 1610 includes, inter alia, a water pump assembly 100, engine assembly 1620, and radiator assembly 1630. The cooling system 1610 can be designed to circulate coolant 1660 to the engine assembly 1610. The water pump assembly 100 includes an integrated thermostat that includes a temperature-controlled valve assembly 400. As mentioned above, the temperature-controlled valve assembly 400 may include a primary valve 402 and a bypass valve 404, and the primary valve 402 can transition between a closed position 1640 and an open position 1650.

When the primary valve 404 is arranged in the closed position 1640, a first passageway 1645 inside the housing 200 directs the flow of the coolant 1660 to the engine assembly 1620. In this scenario, the bypass valve 404 may be in an open position to permit circulation of the coolant 1660 between the engine assembly 1620 and the water pump assembly 100. The primary valve 404 may transition to an open position 1650 when the temperature of the coolant 1660 exceeds a predetermined temperature. When the primary valve 402 is arranged in the open position, the bypass valve 404 may transition to a closed position and a second passageway 1655 inside the housing directs the flow of the coolant to the radiator assembly 1630, which can permit heat to dissipate from the coolant 1660. In the second passageway 1655, the flow of coolant 1660 inside the housing passes through the opened primary valve 402 and out the feed line 208 to the radiator assembly 1630. The radiation assembly 1630 may then direct the coolant to the engine assembly 1620.

One of ordinary skill in the art would recognize that the shapes, configurations, and/or structures of the water pump assemblies 110 can vary, and that the components (e.g., the fasteners 120, retainer structures 130, gaskets 140, etc.) of the water pump assemblies 110 can be incorporated into the water pump assemblies in a manner that accommodates the varying shapes, configurations, and/or structures of the water pump assemblies 110.

While various novel features of the invention have been shown, described, and pointed out as applied to particular embodiments thereof, it should be understood that various omissions and substitutions and changes in the form and details of the systems and methods described and illustrated, may be made by those skilled in the art without departing from the spirit of the invention. Amongst other things, the steps in the methods may be carried out in different orders in many cases where such may be appropriate. Those skilled in the art will recognize, based on the above disclosure and an understanding therefrom of the teachings of the invention and the general functionality provided by and incorporated therein, may vary in different embodiments of the invention. Accordingly, the description of system components are for illustrative purposes to facilitate a full and complete understanding and appreciation of the various aspects and functionality of particular embodiments of the invention as realized in system and method embodiments thereof. Those skilled in the art will appreciate that the invention can be practiced in other than the described embodiments, which are presented for purposes of illustration and not limitation. Variations, modifications, and other implementations of what is described herein may occur to those of ordinary skill in the art without departing from the spirit and scope of the present invention.

What is claimed is:

1. A pre-packaged water pump assembly comprising:

a package comprising a water pump assembly;

the water pump assembly further comprising:

a housing including an exterior surface and one or more openings that extend through the exterior surface of the housing;

one or more retainer structures positioned on the exterior surface of the housing, the one or more retainer structures comprising one or more apertures, each of the apertures in the one or more retainer structures corresponding to one or more openings of the housing;

a plurality of pre-mounted fasteners enabling connection of the housing to an engine assembly via one or more of the openings that extend through the exterior surface of the housing, the plurality of pre-mounted fasteners inserted into one or more of the retainer structures via one or more of the corresponding apertures in the retainer structure prior to connection of the housing to the engine assembly; and a thermostat integrated into the housing of the water pump assembly, the thermostat comprising a temperature-controlled valve assembly configured to regulate a flow of coolant to the engine assembly.

2. The pre-packaged water pump assembly of claim 1, wherein:

the water pump assembly further comprises one or more pre-mounted gaskets;

the one or more pre-mounted gaskets are connected to an exterior of the housing and are adapted to seal a connection between the housing of the water pump assembly and the engine assembly.

3. The pre-packaged water pump assembly of claim 1, wherein:

the retainer structure is composed of a plastic.

4. The pre-packaged water pump assembly of claim 1, wherein:

the one or more retainer structures connect the plurality of pre-mounted fasteners to the housing.

5. The pre-packaged water pump assembly of claim 1, wherein:

the temperature-controlled valve assembly includes a primary valve and a bypass valve; and the primary valve is configured to transition between an open position and a closed position within the housing of the water pump assembly.

6. The pre-packaged water pump assembly of claim 5, wherein:

when the primary valve is arranged in the closed position, a first passageway inside the housing directs the flow of the coolant to the engine assembly; and when the primary valve is arranged in the open position, a second passageway inside the housing directs the flow of the coolant through a radiator assembly.

7. The pre-packaged water pump assembly of claim 1, wherein:

the temperature-controlled valve assembly comprises:

a primary valve;

a bypass valve located opposite the primary valve;

a charge cylinder extending between the primary valve and the bypass valve; and at least one spring surrounding the charge cylinder; and the primary valve, the bypass valve, the charge cylinder, and the at least one spring are included within the housing of the water pump assembly.

8. A pre-packaged water pump assembly comprising:

a package comprising a water pump assembly;

the water pump assembly further comprising:

a housing including an exterior surface and one or more openings that extend through the exterior surface of the housing;

one or more retainer structures positioned on the exterior surface of the housing, the one or more retainer structures comprising one or more apertures, each of the apertures in the one or more retainer structures corresponding to one or more openings of the housing;

a plurality of pre-installed fasteners enabling connection of the housing to an engine assembly via one or more of the openings that extend through the exterior surface of the housing, the plurality of pre-installed fasteners inserted into one or more of the retainer structures via one or more of the corresponding apertures in the retainer structure prior to connection of the housing to the engine assembly; and a thermostat comprising a temperature-controlled valve assembly, the temperature-controlled valve assembly at least including:

a primary valve;

a bypass valve;

a charge cylinder; and a spring surrounding the charge cylinder; and wherein:

the thermostat is configured to regulate a flow of coolant to an engine assembly;

the primary valve, the bypass valve, the charge cylinder, and the spring are included within the housing of the water pump assembly;

the primary valve is configured to transition between an open position and a closed position within the housing of the water pump assembly;

when the primary valve is arranged in the closed position, a first passageway inside the housing directs the flow of the coolant to the engine assembly; and when the primary valve is arranged in the open position, a second passageway inside the housing directs the flow of the coolant through a radiator assembly.

9. The pre-packaged water pump assembly of claim 8, wherein:

the water pump assembly further comprises one or more pre-installed gaskets;

the one or more pre-installed gaskets are connected to an exterior of the housing and adapted to seal a connection between the housing of the water pump assembly and the engine assembly.

10. The pre-packaged water pump assembly of claim 8, wherein:

the retainer structure is composed of a plastic.

11. The pre-packaged water pump assembly of claim 8, wherein:

the one or more retainer structures connect the plurality of pre-installed fasteners to the housing.

12. The pre-packaged water pump assembly of claim 8, wherein:

the bypass valve is located opposite the primary valve;

the charge cylinder extends between the primary valve and the bypass valve; and the spring surrounds the charge cylinder.

13. The pre-packaged water pump assembly of claim 1, wherein the retainer structure is unthreaded.

14. The pre-packaged water pump assembly of claim 1, wherein the apertures in the one or more retainer structures are tapered.

15. The pre-packaged water pump assembly of claim 1, wherein the apertures in the one or more retainer structures are straight.

16. The pre-packaged water pump assembly of claim 8, wherein the retainer structure is unthreaded.

17. The pre-packaged water pump assembly of claim 8, wherein the apertures in the one or more retainer structures are tapered.

18. The pre-packaged water pump assembly of claim 8, wherein the apertures in the one or more retainer structures are straight.

19. A water pump assembly that includes a plurality of pre-packaged components comprising:

a housing including a surface and one or more openings that extend through the surface of the housing;

one or more retainer structures positioned on the surface of the housing proximate to one or more openings of the housing;

a plurality of pre-mounted fasteners, wherein:

the plurality of pre-mounted fasteners enable connection of the housing to an engine assembly via one or more of the openings that extend through the surface of the housing;

prior to connection of the housing to the engine assembly, the plurality of pre-mounted fasteners are secured to the housing by the one or more retainer structures; and the one or more retainer structures comprise a plurality of apertures that are designed and configured to receive the plurality of pre-mounted fasteners and attach the pre-mounted fasteners to the housing;

a thermostat integrated into the housing of the water pump assembly, the thermostat comprising a temperature-controlled valve assembly configured to regulate a flow of coolant to the engine assembly; and at least one pre-installed gasket connected to the housing of the water pump assembly and adapted to seal a connection between the housing of the water pump assembly and the engine assembly, wherein:

the at least one pre-installed gasket is attached on an exterior portion of the housing prior to connection of the housing to the engine assembly; and the at least one pre-installed gasket is located at a location on the exterior portion of the housing where the water pump assembly and engine assembly are configured to interface with each other wherein the plurality of pre-mounted fasteners, the thermostat, and the at least one pre-installed gasket are pre-installed on, and attached to, the water pump assembly prior to water pump assembly being connected to the engine assembly.

* * * * *